US008197044B2

(12) United States Patent
Kanbe et al.

(10) Patent No.: US 8,197,044 B2
(45) Date of Patent: Jun. 12, 2012

(54) INK CARTRIDGES

(75) Inventors: Tomohiro Kanbe, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 988 days.

(21) Appl. No.: 12/023,228

(22) Filed: Jan. 31, 2008

(65) Prior Publication Data

US 2009/0096848 A1 Apr. 16, 2009

(30) Foreign Application Priority Data

Oct. 15, 2007 (JP) ..... 2007-268267

(51) Int. Cl.
*B41J 2/175* (2006.01)

(52) U.S. Cl. ..... 347/86

(58) Field of Classification Search ..... 347/7, 86
See application file for complete search history.

(56) References Cited

U.S. PATENT DOCUMENTS

| | | | | |
|---|---|---|---|---|
| 6,257,712 | B1 | 7/2001 | Haigo | |
| 7,188,939 | B1 | 3/2007 | Sasaki | |
| 7,222,950 | B2 * | 5/2007 | Hattori et al. | 347/86 |
| 7,316,471 | B2 | 1/2008 | Hattori et al. | |
| 7,416,290 | B2 * | 8/2008 | Hattori et al. | 347/86 |
| 2003/0184626 | A1 | 10/2003 | Sasaki et al. | |
| 2007/0229615 | A1 | 10/2007 | Hattori et al. | |
| 2008/0049082 | A1 * | 2/2008 | Hattori et al. | 347/86 |
| 2008/0239033 | A1 * | 10/2008 | Hattori | 347/86 |
| 2008/0297576 | A1 * | 12/2008 | Hattori et al. | 347/86 |

FOREIGN PATENT DOCUMENTS

| | | | |
|---|---|---|---|
| EP | 1097814 | A | 5/2001 |
| EP | 1772270 | A | 4/2007 |
| EP | 1792736 | A | 6/2007 |
| EP | 1839871 | A | 10/2007 |
| EP | 1839873 | A | 10/2007 |
| EP | 1886821 | A | 2/2008 |
| JP | H07-314716 | A | 12/1995 |
| JP | H11-198393 | A | 7/1999 |
| JP | 2007-144811 | A | 6/2007 |

OTHER PUBLICATIONS

European Patent Office, European Search Report for Corresponding European Patent Application No. 08003715, mailed Jul. 3, 2008.
European Patent Office, European Search Report for European Patent Application No. 08003715 (counterpart to above-captioned patent application), dated May 27, 2008.
European Patent Office, European Search Report for European Patent Application No. 10015742 (counterpart to above-captioned patent application), dated Mar. 3, 2011.
Japan Patent Office, Notice of Reasons for Rejection for Japanese Patent Application No. 2007-268267 (counterpart to above-captioned patent application), mailed Mar. 21, 2012.

* cited by examiner

*Primary Examiner* — Anh T. N. Vo
(74) *Attorney, Agent, or Firm* — Baker Botts L.L.P.

(57) ABSTRACT

An ink cartridge includes a frame and a movable member. At least the frame defines an ink chamber therein, and the ink chamber is configured to store ink therein. The movable member is configured to move within the ink chamber in a first direction and a second direction opposite the first direction. The movable member includes a plurality of projections, and each of the plurality of projections extend from a surface of the movable member in one of the first direction and the second direction.

35 Claims, 19 Drawing Sheets

INK CARTRIDGES

CROSS-REFERENCE TO RELATED APPLICATION

The present application claims priority from Japanese Patent Application No. JP-2007-268267, which was filed on Oct. 15, 2007, the disclosure of which is incorporated herein by reference in its entirety.

BACKGROUND OF THE INVENTION

1. Field of the Invention

The present invention relates generally to ink cartridges. In particular, the present invention is directed towards ink cartridges which may be used in combination with ink jet printers.

2. Description of Related Art

A known ink jet printer is configured to dispense ink onto a sheet of paper to record an image on the sheet of paper. The known ink jet printer has a recording head. The recording head is configured to selectively eject ink from nozzles to the sheet of paper. A known ink cartridge is configured to be removably mounted to the ink jet printer. The ink cartridge has an ink chamber configured to store ink therein, and ink is supplied from the ink chamber to the recording head when the ink cartridge is mounted to the ink jet printer.

The ink cartridge has a movable member positioned in the ink chamber. The movable member is configured to pivot based on the amount of ink stored in the ink chamber. When the ink is consumed and the amount of ink in the ink chamber becomes less than a sufficient amount of ink, an end of the movable member moves from a first position at which the end of the movable member is detected by a detector e.g., an optical sensor, to a second position at which the end of the movable member is not detected by the detector. Consequently, whether the ink chamber has a sufficient amount of ink stored therein may be determined based on the position of the end of the movable member.

The movable member is submerged in ink when the ink chamber has an amount of ink which is substantially greater than a sufficient amount of ink. As the ink in the ink chamber gradually decreases, the movable member gradually becomes exposed above the surface of the ink. When the movable member is exposed from the surface of the ink, a web-shaped film of ink or a balloon-shaped film of ink may be formed between the movable member and inner wall of the ink chamber. The film may inhibit or restrict the pivotal motion of the movable member, and the end of movable member may not be detected accurately. For example, when the movable member attempts to pivot away from the surface of the ink, the film may draw the movable member towards the inner wall of the ink chamber.

SUMMARY OF THE INVENTION

Therefore, a need has arisen for ink cartridges which overcome these and other shortcomings of the related art. A technical advantage of the present invention is that a movable member readily may pivot in a direction away from a surface of ink.

According to an embodiment of the present invention, an ink cartridge comprises a frame, a translucent portion, a movable member, a signal blocking portion, and an arm portion. At least the frame defines an ink chamber therein, and the ink chamber is configured to store ink therein. The translucent portion, extending from the frame in a first direction, has an inner space formed therein, and the inner space is configured to be in fluid communication with the ink chamber. The movable member is configured to selectively move within the ink chamber in a second direction between a first position and a second position and in a third direction opposite the second direction between the second position and the first position based on an amount of ink in the ink chamber. The first direction is substantially perpendicular to the second direction and the third direction, and the movable member comprises a signal blocking portion configured to be positioned within the inner space of the translucent portion and an arm portion connected to the signal blocking portion. The arm portion is positioned within the ink chamber and outside the translucent portion, and the arm portion comprises a first portion and a second portion. The first portion is raised with respect to the second portion in one of the second direction and the third direction.

According to another embodiment of the present invention, an ink cartridge comprises a frame and a movable member. At least the frame defines an ink chamber therein and the ink chamber is configured to store ink therein. The movable member is configured to move within the ink chamber in a first direction and a second direction opposite the first direction. The movable member comprises a plurality of projections and each of the plurality of projections extend from a surface of the movable member in one of the first direction and the second direction.

According to yet another embodiment of the present invention, an ink cartridge comprises a frame and a movable member. At least the frame defines an ink chamber therein and the ink chamber is configured to store ink therein. The movable member is configured to move within the ink chamber in a first direction and a second direction opposite the first direction and the movable member has at least one groove formed therein. The at least one groove is bound by a first portion, a second portion opposite the first portion and a base connected to the first portion and the second portion. The base faces toward an opening of the at least one groove and is exposed in one of the first direction and the second direction.

According to still yet another embodiment of the present invention, an ink cartridge comprises a frame, a movable member, and a partitioning plate. At least the frame defines an ink chamber therein and the ink chamber is configured to store ink therein. The movable member is configured to move within the ink chamber. The partitioning member extending from the frame towards the movable member and comprises a plurality of projections extending from a surface of the partitioning member toward the movable member.

According to a further embodiment of the present invention, an ink cartridge comprises a frame, movable member, and a partitioning plate. At least the frame defines an ink chamber therein and the ink chamber is configured to store ink therein. The movable member is configured to move within the ink chamber. The partitioning member extending from the frame towards the movable member and has at least one groove formed therein. The at least one groove is bound by a first portion, a second portion opposite the first portion. A base connected to the first portion and the second portion and faces toward an opening of the at least one groove, and is exposed in a direction toward the movable member.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1(A)-19, like numerals being used for like corresponding portions in the various drawings.

Figure 1B:
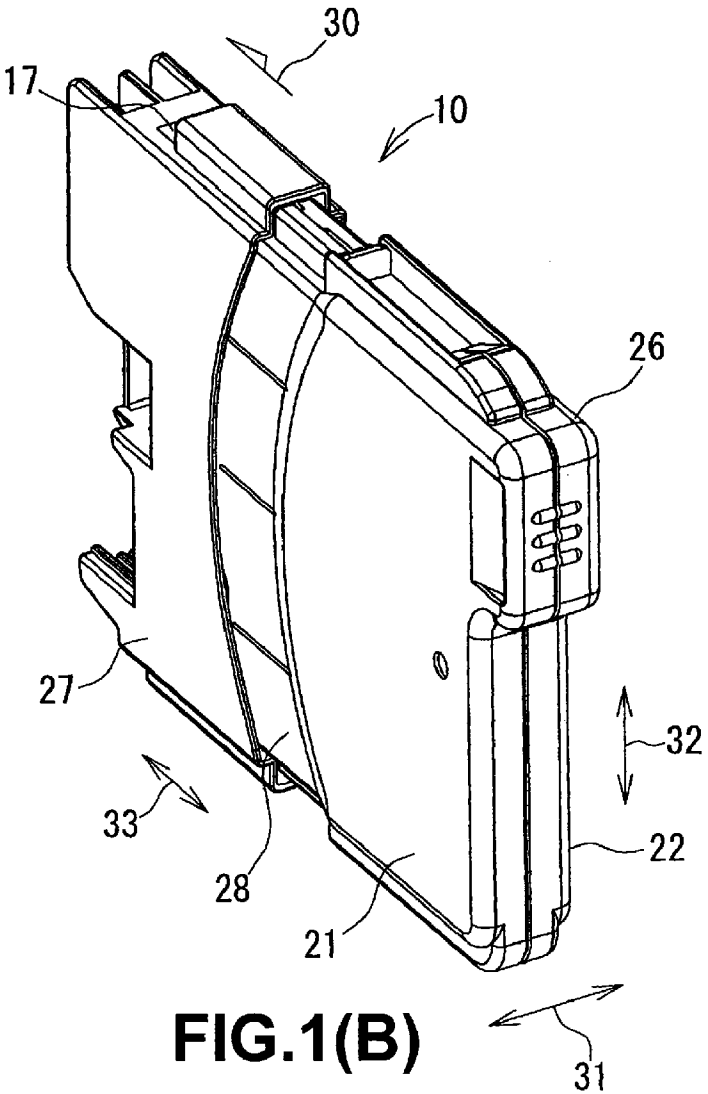
FIGS. 1(A) and 1(B) are a perspective view of a front side and a rear side, respectively, of an ink cartridge 10, according to the present invention.
Figure 1A:
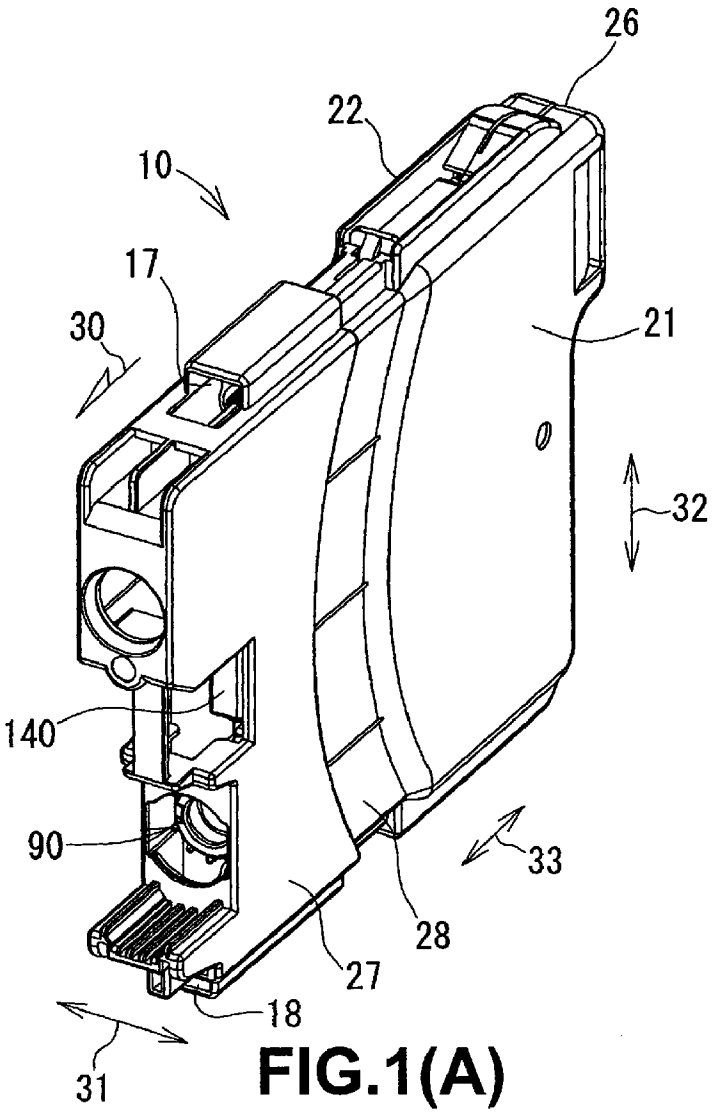

Referring to FIGS. 1(A) and 1(B), an ink cartridge 10 may be configured to be removably mounted to an ink jet recording apparatus (not shown), such as an ink jet printer. For example, ink cartridge 10 may be mounted in a cartridge storage section (not shown) of the recording apparatus when ink cartridge 10 is inserted in a direction of insertion 30.

Figure 2:
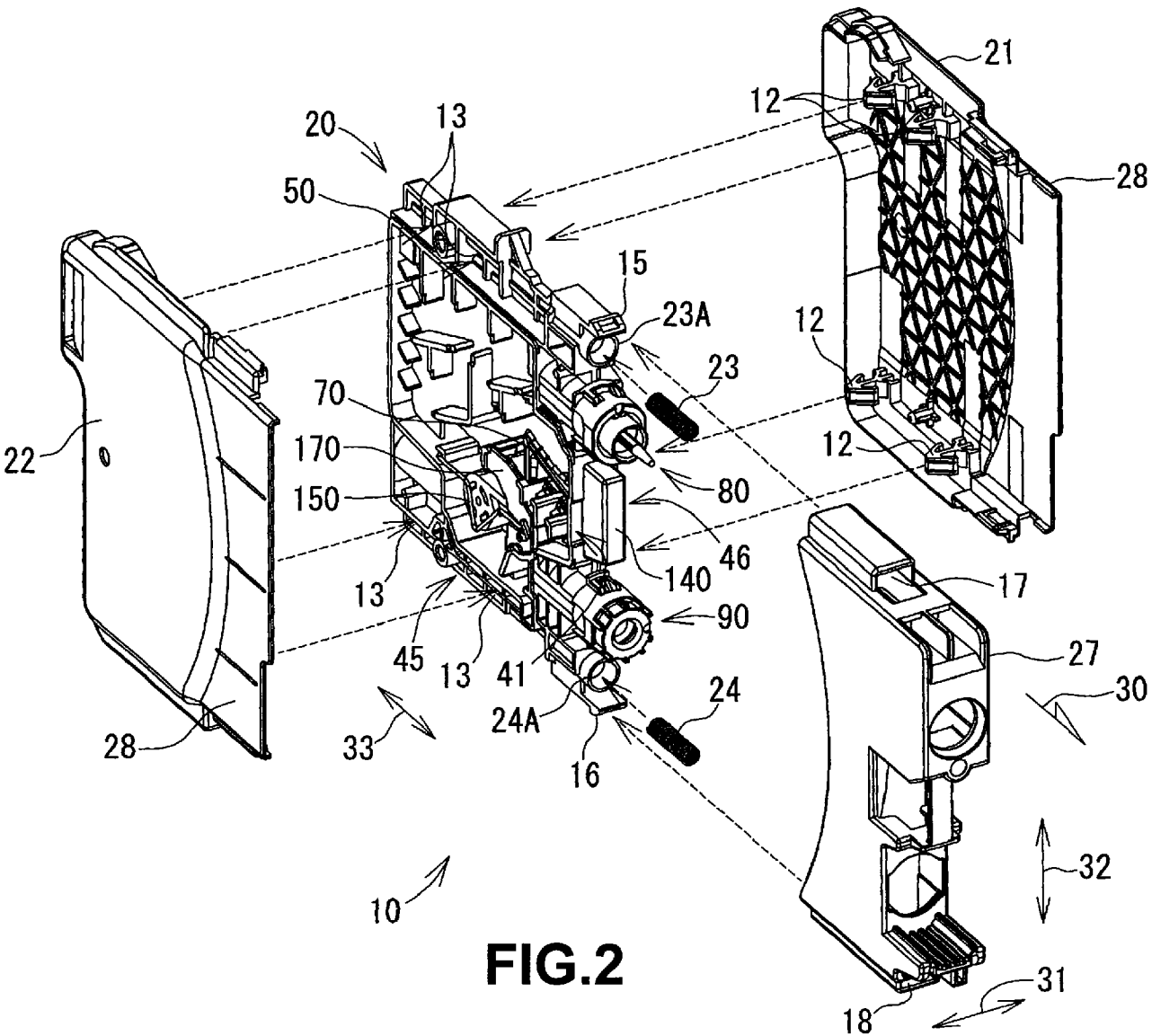
FIG. 2 is an exploded, perspective view of the ink cartridge of FIGS. 1(A) and 1(B).
Figure 3A:
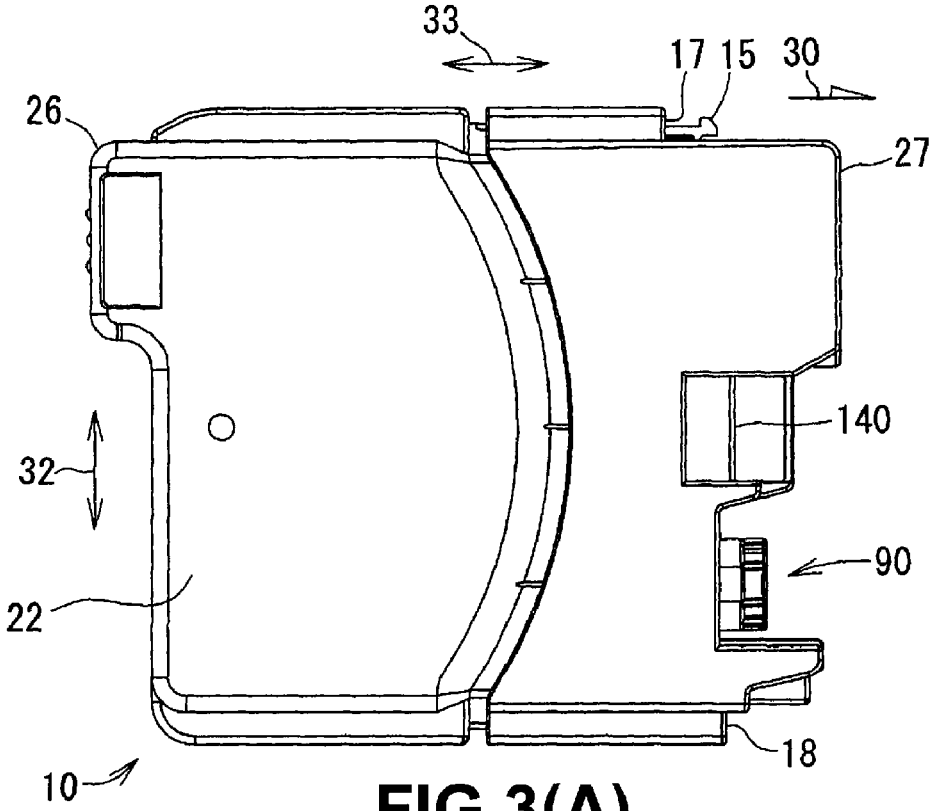
FIG. 3 is a side view of the ink cartridge of FIG.(A) and 1(B).
Figure 3B:
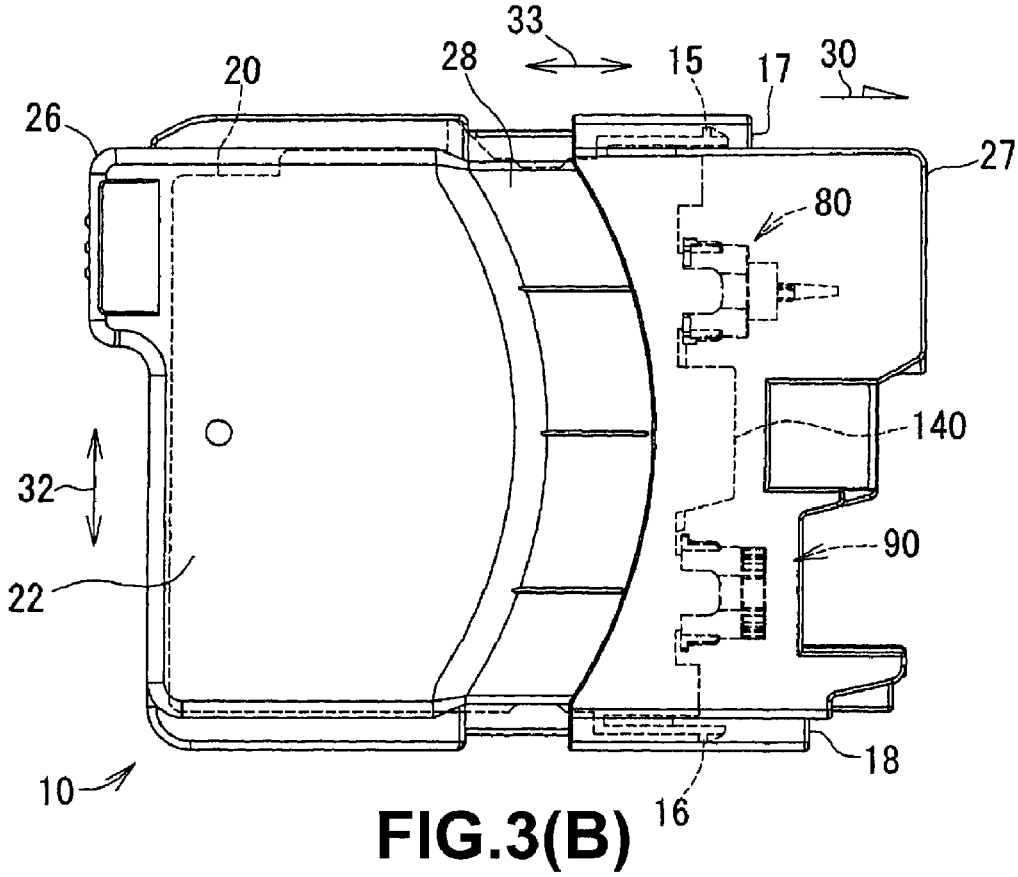

The ink cartridge 10 may have a substantially flat, hexahedron shape, e.g., a substantially rectangular, parallelepiped shape, and may be more narrow in a widthwise direction, as indicated by an arrow 31, than in a height direction, as indicated by an arrow 32, and a depth direction, as indicated by an arrow 33. Referring to FIGS. 1(A)-2, the ink cartridge 10 may comprise an ink container 20, a case, e.g., a housing 26, a movable member, e.g., a slider 27, and a pair of coil springs 23 and 24, in which the housing 26 and the slider 27 may form an outer shell of the ink cartridge 10. The ink container 20 may comprise a frame 50, an air communication valve 80, and an ink supply valve 90.

The housing 26 may be configured to protect the ink container 20. For example, each portion of the ink container 20 other than a front surface 41 may be covered by the housing 26. The housing 26 may comprise a first cover 21 and a second cover 22 configured to enclose the ink container 20. The first cover 21 may be attached to a right side surface 46 of the ink container 20 via a plurality of engaging claws 12 positioned on the inner surface of the first cover 21, which engage engaging grooves 13 positioned on the ink container 20. Accordingly, the right side surface 46 of the ink container 20 is covered by the first cover 21. Similarly, the second cover 22 is attached to a left side surface 45 of the ink container 20, such that the left side surface 45 of the ink container 20 is covered by the second cover 22. The covers 21 and 22 may have a shape which allows covers 21 and 22 to avoid interfering with the frame 50, the air communication valve 80, and the ink supply valve 90.

The slider 27 may be configured to protect the air communication valve 80 and the ink supply valve 90. The slider 27 may be removably attached to the ink container 20, and an inner surface of the slider 27 may contact the coil springs 23 and 24. The coil spring 23 may be mounted to a spring receiver 23A formed at the upper portion of the front surface 41 of the ink container 20, the coil spring 24 may be mounted to a spring receiver 24A formed at the bottom portion of the front surface 41, and the engaging claws 15 and 16 may engage a pair of engaging grooves 17 and 18, respectively, positioned on the slider 27, such that a front portion 28 of the housing 26 is covered by the slider 27.

The ink container 20 may comprise frame 50, an arm 70, a supporting block 170, a protecting member 150, the air communication valve 80, the ink supply valve 90, and at least one film 65, e.g., a pair of films 65. The frame 50 may be a housing of the ink container 20, which defines surfaces 41-46. The frame 50 may comprise a translucent resin, e.g., a transparent resin, and may be formed by injection molding. For example, the frame 50 may comprise polypropylene, polyacetal, nylon, or the like, or any combinations thereof.

The frame 50 may comprise an outer peripheral wall 51 and a plurality of inner walls 52. The inner walls 52 are arranged inside the outer peripheral wall 51. The outer peripheral wall 51 and the inner walls 52 may be integral with the frame 50. The outer peripheral wall 51 and the inner walls 52 may extend from the left side surface 45 to the right side surface 46 of the ink container 20. The outer peripheral wall 51 may be positioned in an annular shape along the front surface 41, the upper surface 43, the rear surface 42, and the lower surface 44 to define a space in the interior thereof. Accordingly, an opening 57 may be positioned on each of the left side surface 45 and the right side surface 46 of the frame 50.

The pair of films 65, e.g., translucent films, may be connected to, e.g., adhered to, the left side surface 45 and the right side surface 46, respectively, of the frame 50 via an adhesion method, e.g., a thermal adhesion method. More specifically, the films 65 may be adhered to both end portions of the outer peripheral wall 51 in the widthwise direction 31. Accordingly, the openings 57 are covered by the films 65, and a space surrounded by the outer peripheral wall 51 and the films 65 is defined as an ink chamber 100. Alternatively, a box-shaped frame which is opened on one side only may be employed instead of the frame 50. In this case, the ink chamber 100 is defined by the film 65 adhered on the opened side of the box shaped frame.

The inner walls 52 may be surrounded by the outer peripheral wall 51. The frame 50 may comprise a partitioning panel 53 which partitions an upper space of the ink chamber 100 at the center in the widthwise direction 31 integrally with the outer peripheral wall 51. The inner walls 52 may be integral with the outer peripheral wall 51 or the partitioning panel 53. The films 65 may be adhered to the inner walls 52 at the both end portions in the widthwise direction 31. Accordingly, inward deformation of the films 65 may be prevented or suppressed. Moreover, although the first cover 21 and the second cover 22 may deform toward the ink container 20, deformation of the first cover 21 and the second cover 22 may be prevented or suppressed by the inner walls 52. Consequently, the ink container 20 and the films 65 may not be damaged. The lower portion of the ink chamber 100, e.g., a space 102, below the partitioning panel 53 may not be partitioned in the widthwise direction 31.

Figure 4:
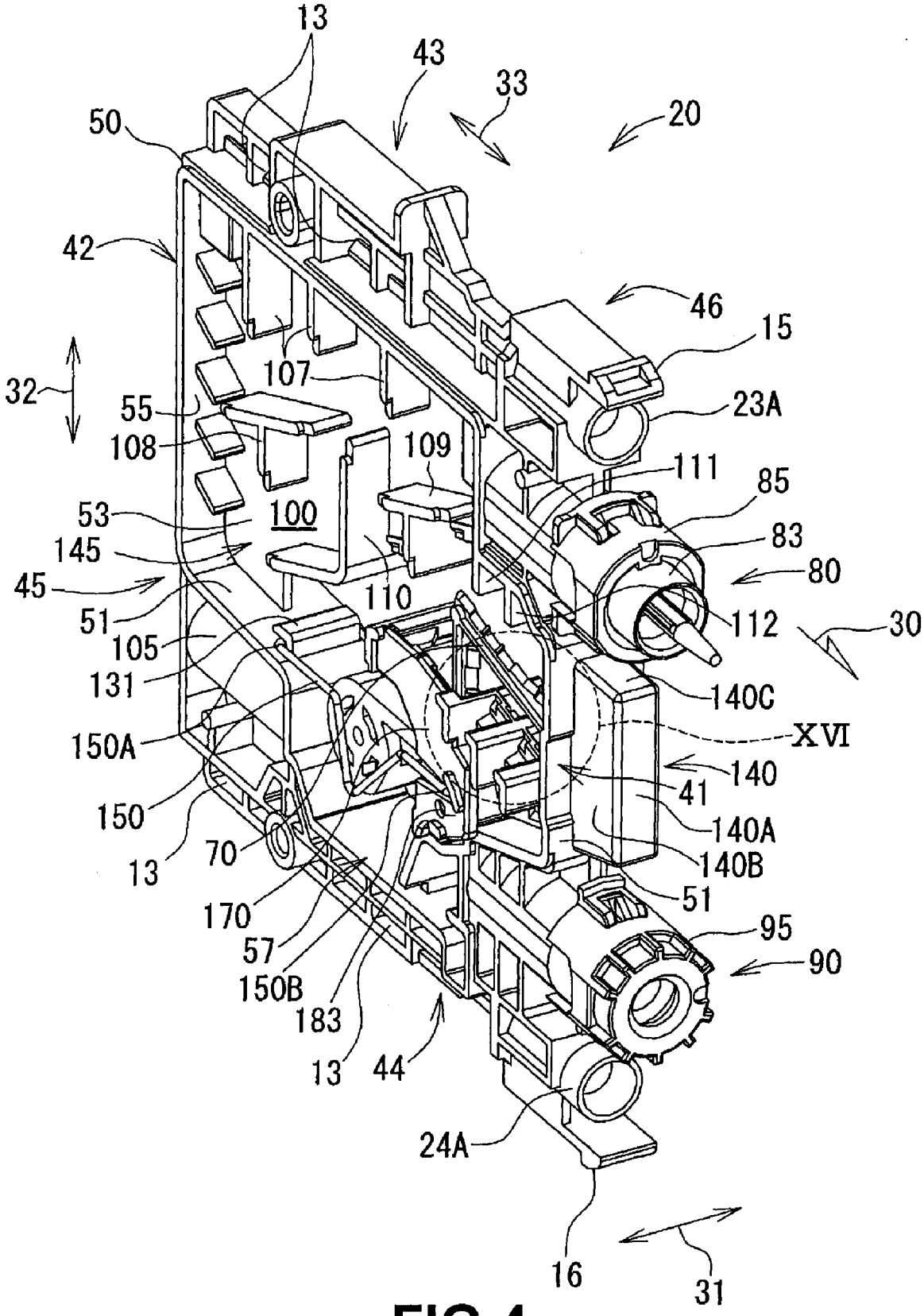
FIG. 4 is an enlarged, perspective view of an ink container, according to an embodiment of the present invention.
Figure 5:
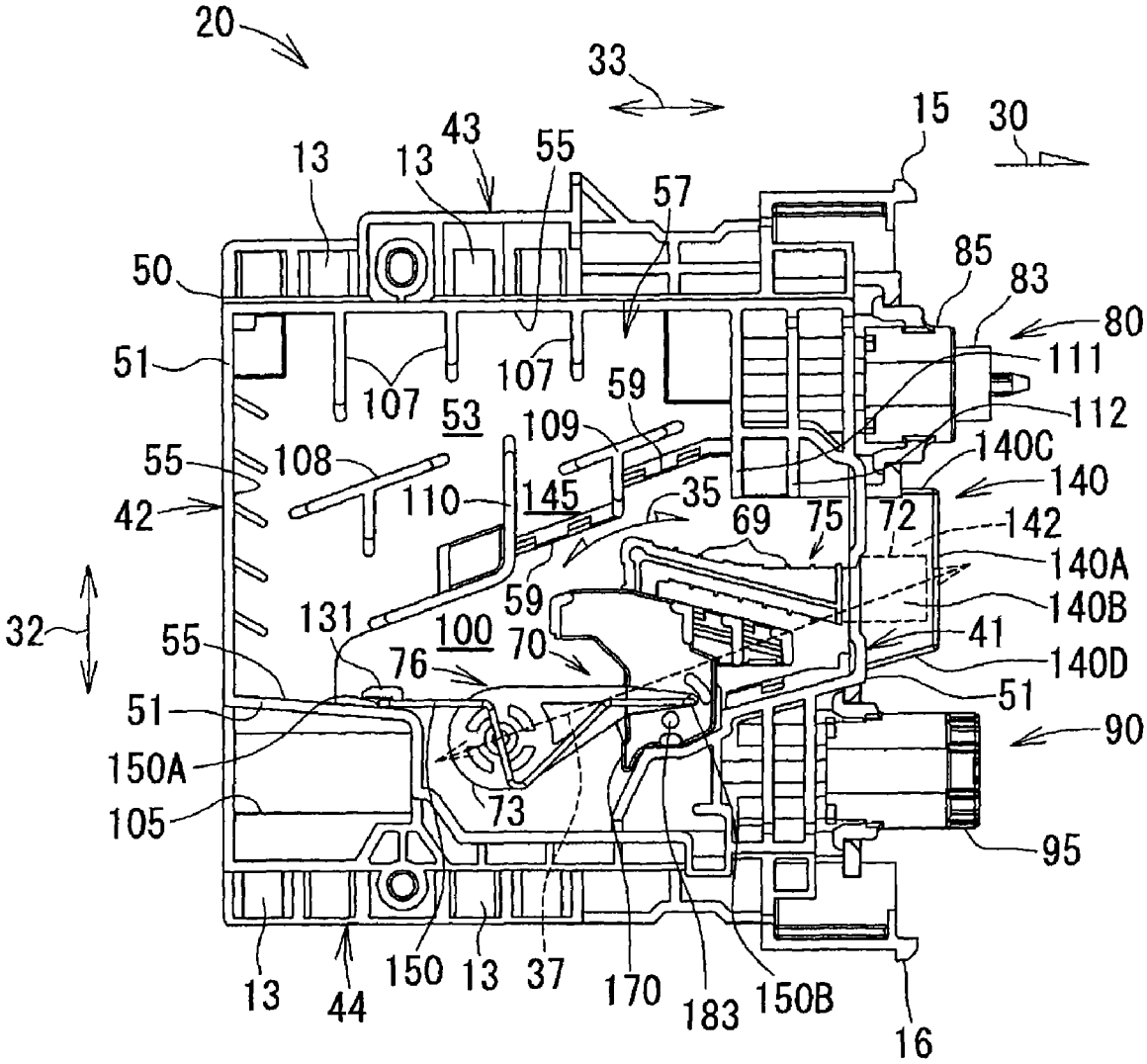
FIG. 5 is a side view showing an internal structure of the ink container of FIG. 4.
Figure 6:
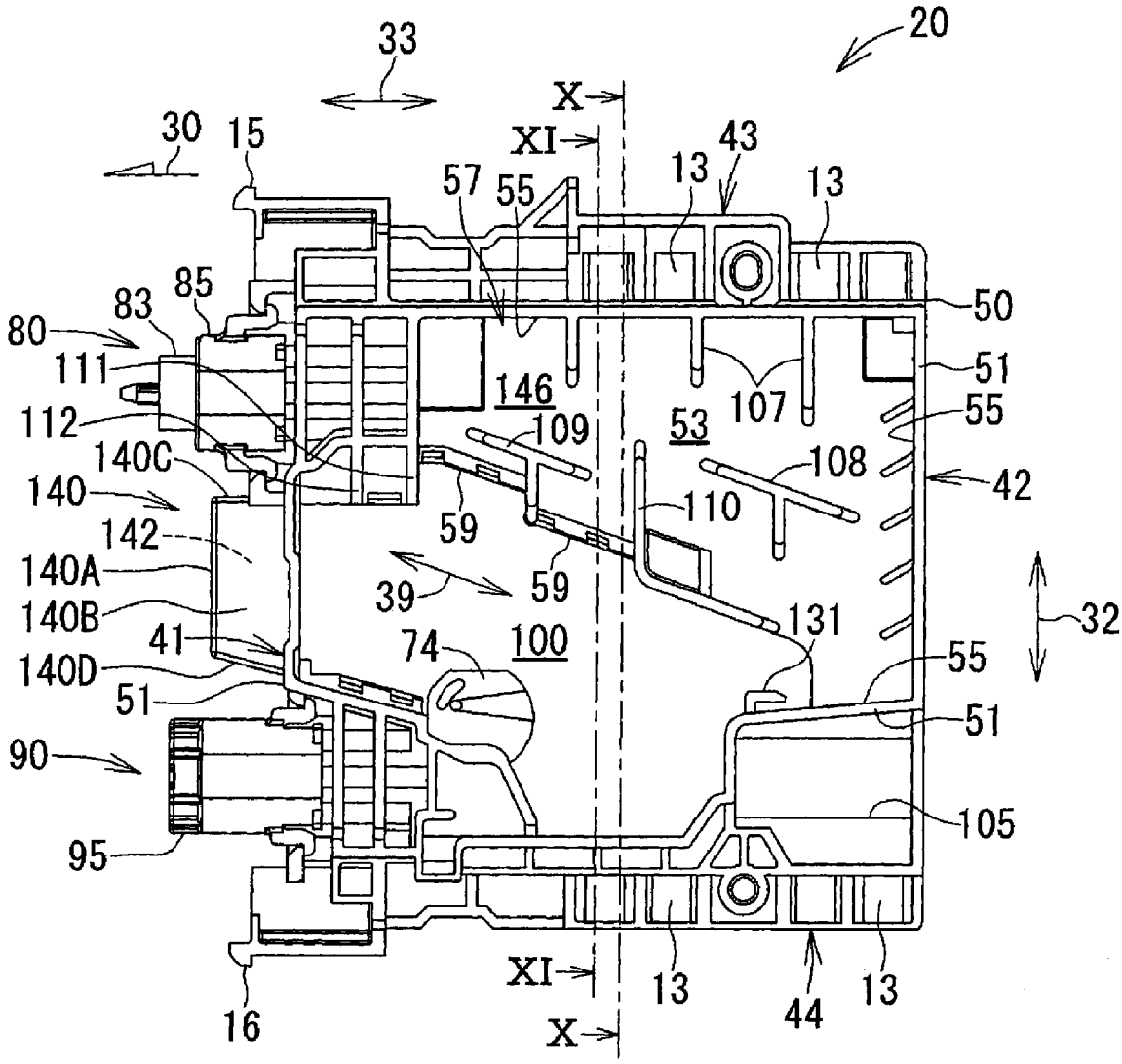
FIG. 6 is an exploded, perspective view of the ink container of FIG. 4.
Figure 7:
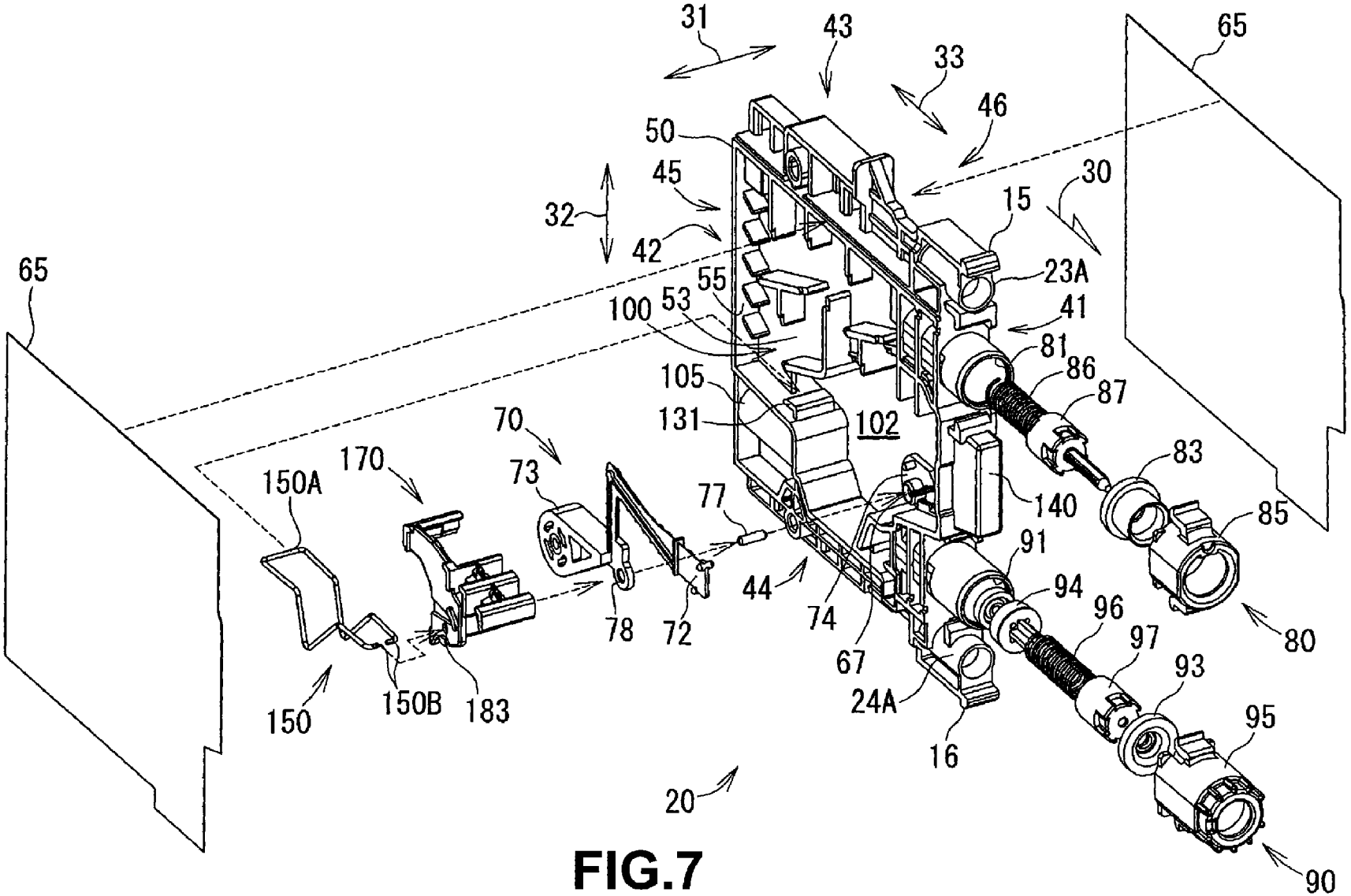
FIG. 7 is an exploded, perspective view of the ink container of FIG. 4.
Figure 8:
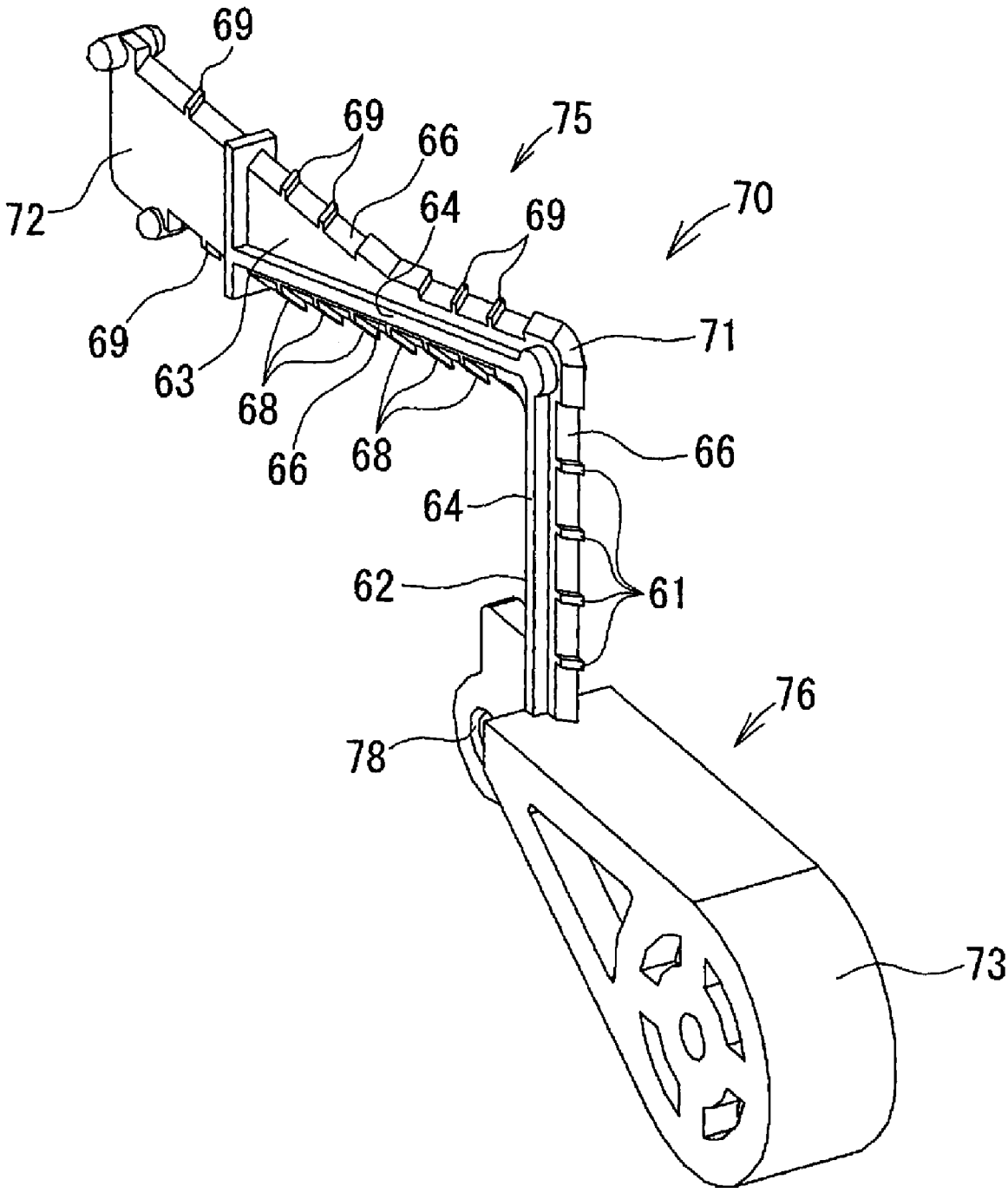
FIG. 8 is a perspective view of an arm, according to an embodiment of the present invention.
Figure 9:
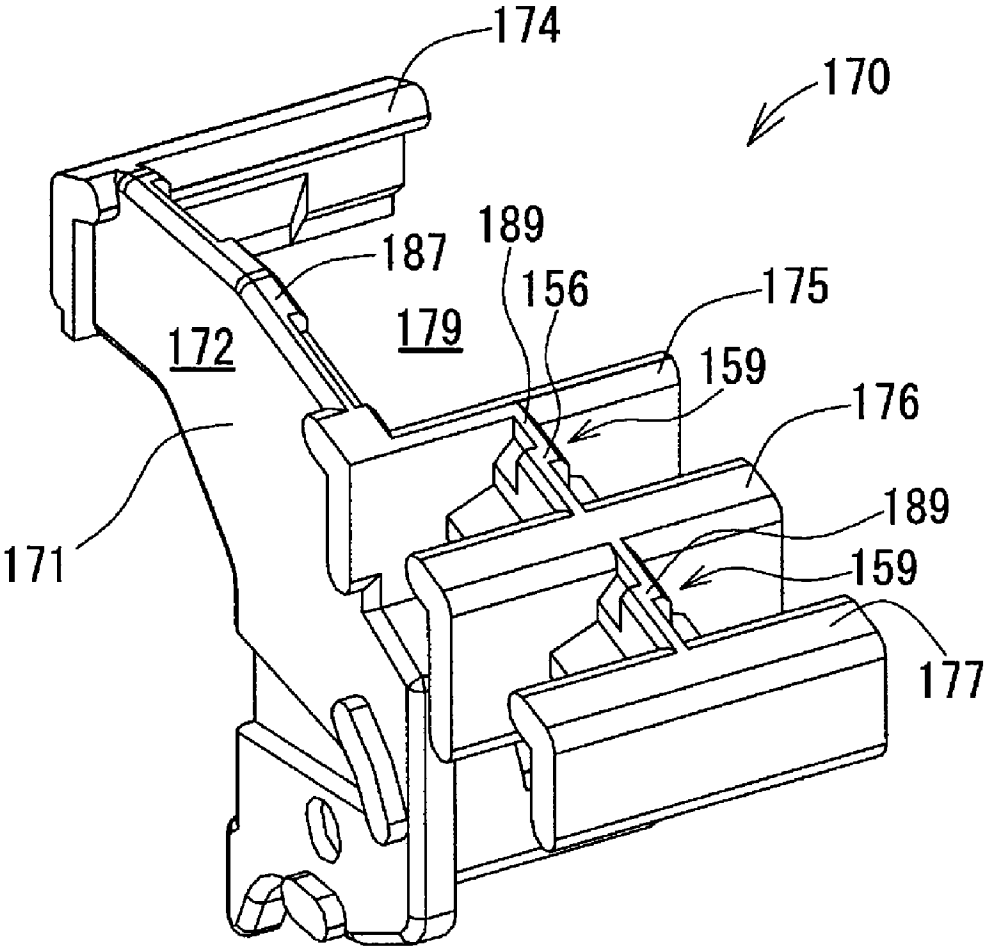
FIG. 9 is a perspective view of a supporting block, according to an embodiment of the present invention.
Figure 10:
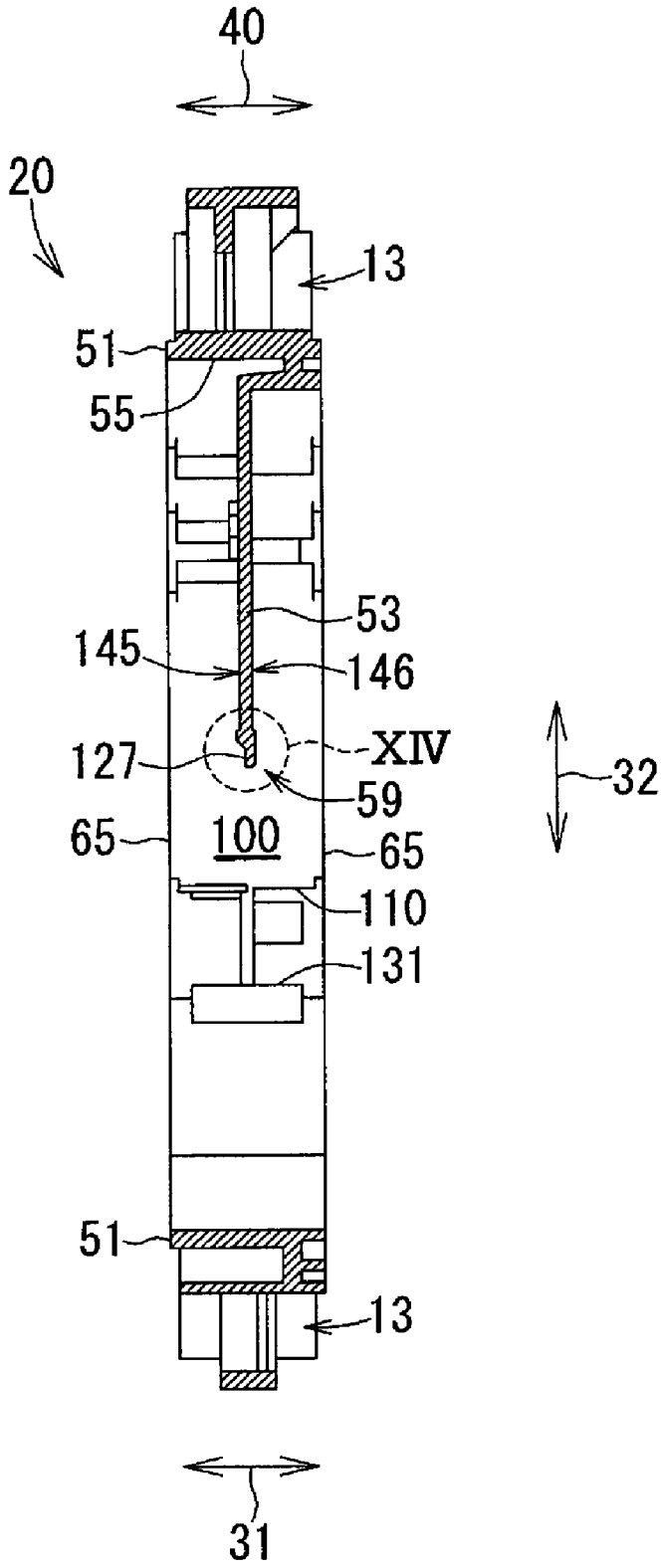
FIG. 10 is a cross-sectional view of the ink cartridge of FIG. 6 taken along a line X-X.
Figure 11:
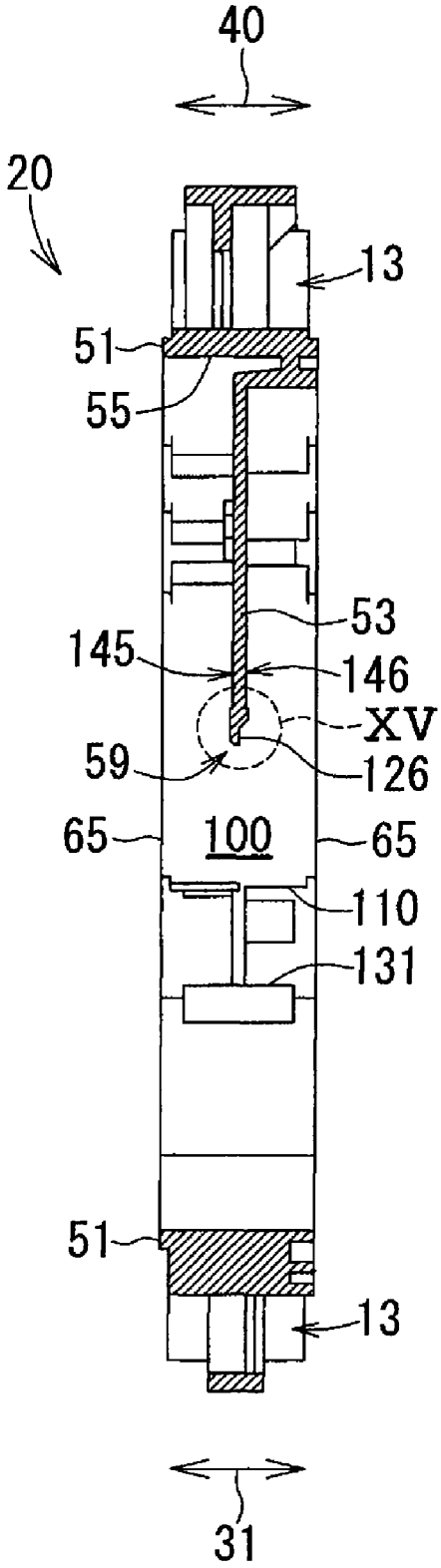
FIG. 11 is a cross-sectional view of the ink cartridge of FIG. 6 taken along a line XI-XI.
Figure 12:
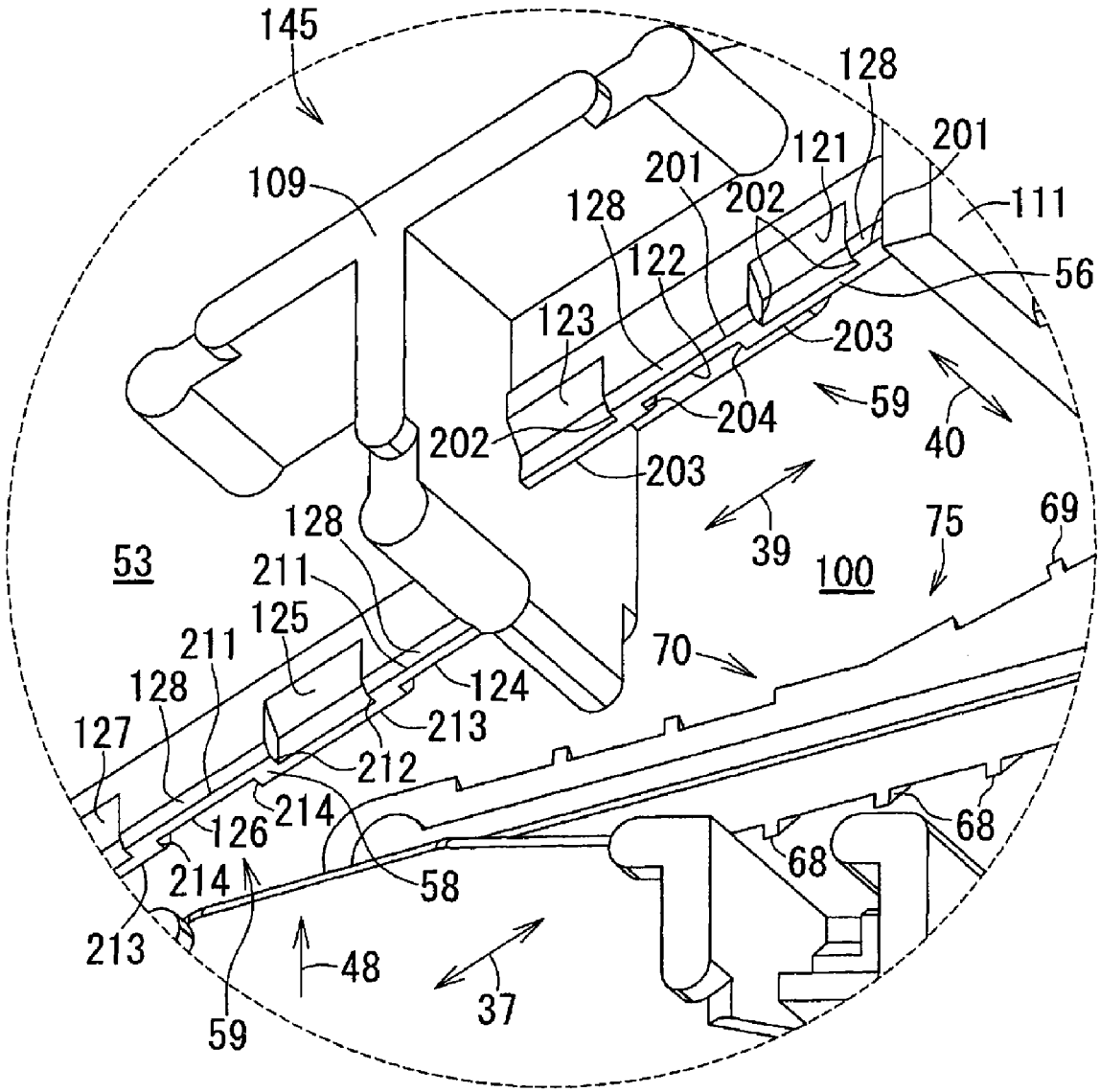
FIG. 12 is an enlarged, perspective view of a leading end of a reinforcing plate, according to an embodiment of the present invention.
Figure 13:
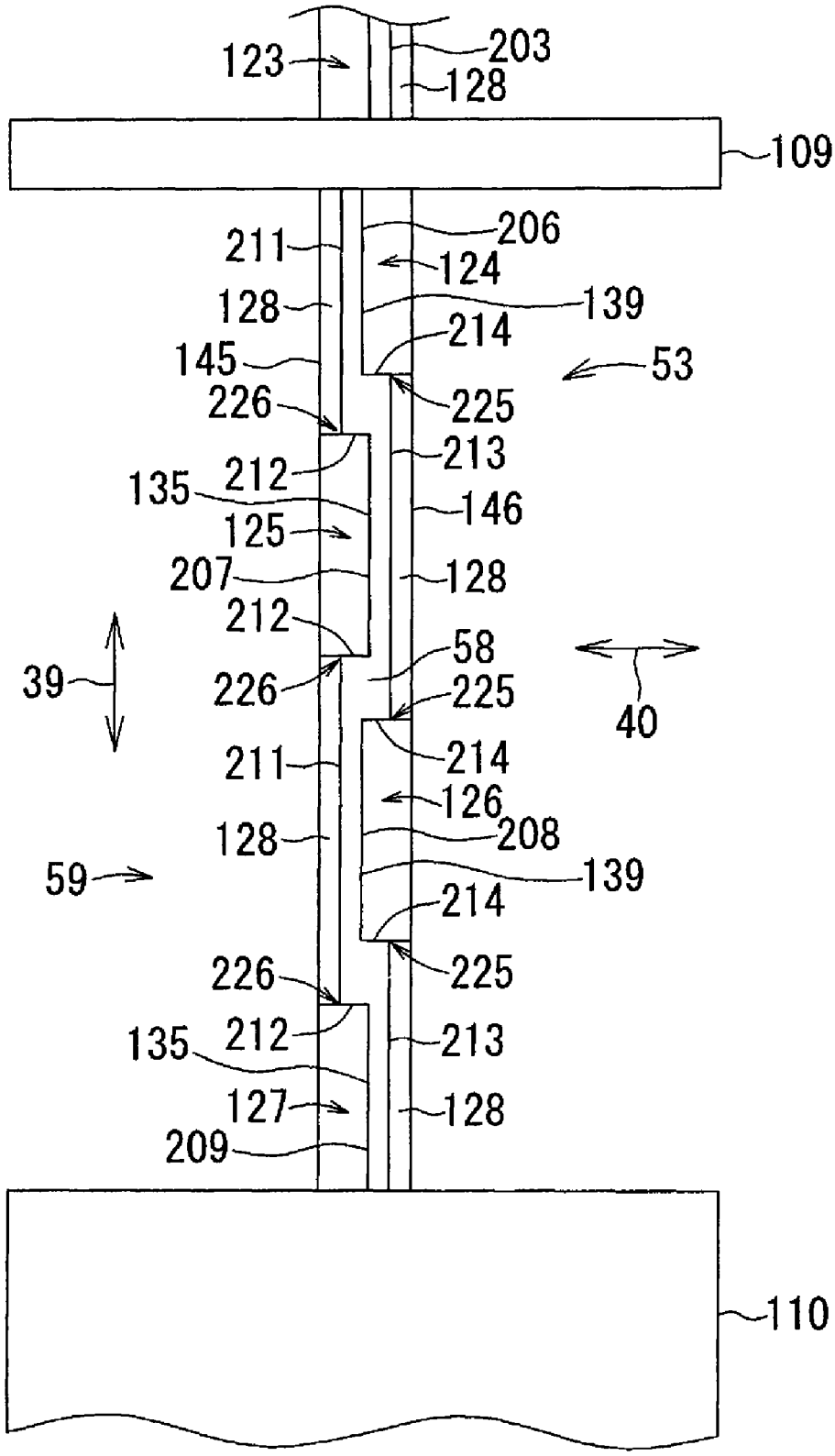
FIG. 13 is a pattern diagram of the leading end of the reinforcing plate viewed from a direction indicated by an arrow in FIG. 12.
Figure 14:
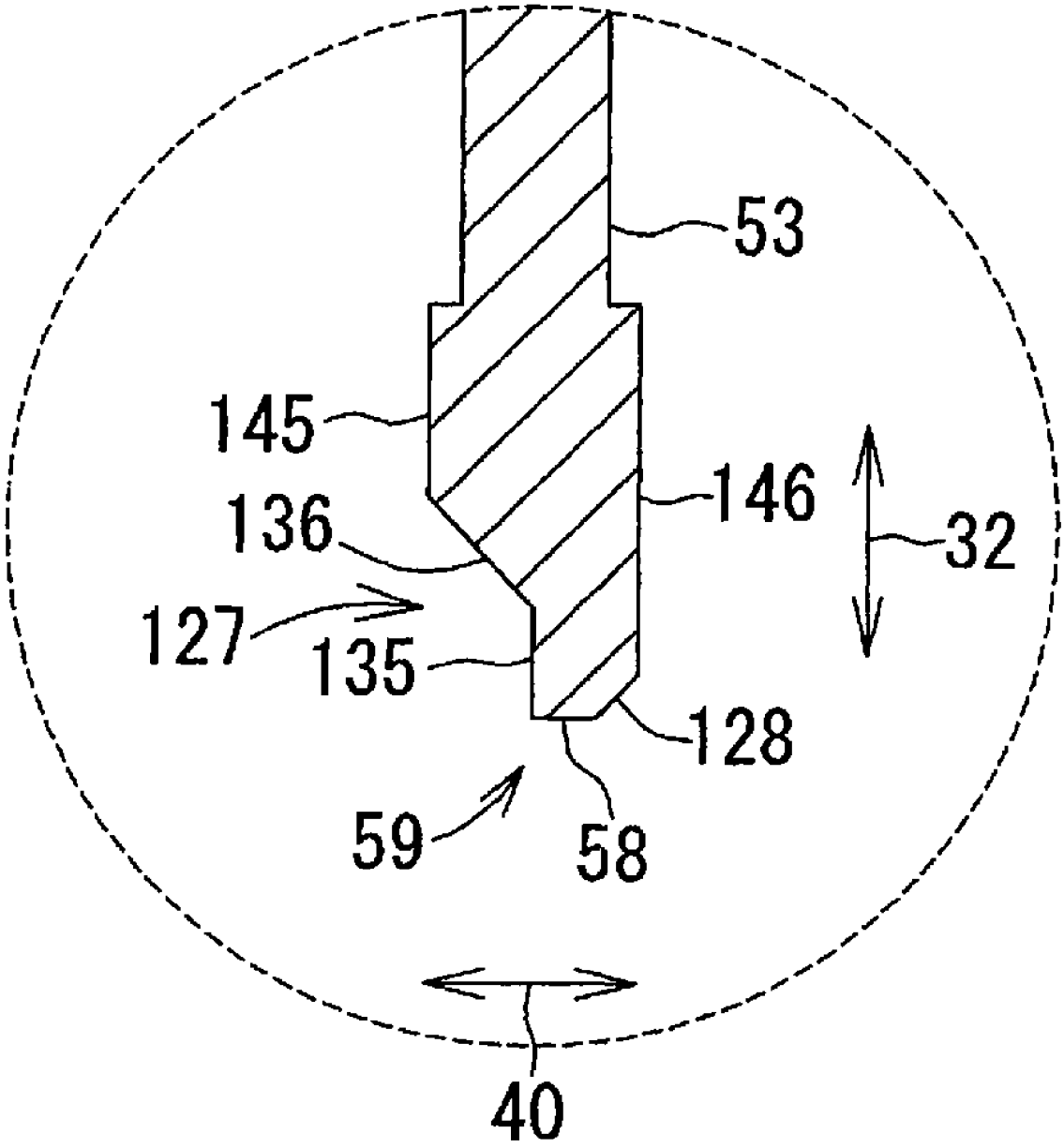
FIG. 14 is a cross-sectional view of the leading end of the reinforcing plate taken along the line XIV-XIV in FIG. 10.
Figure 15:
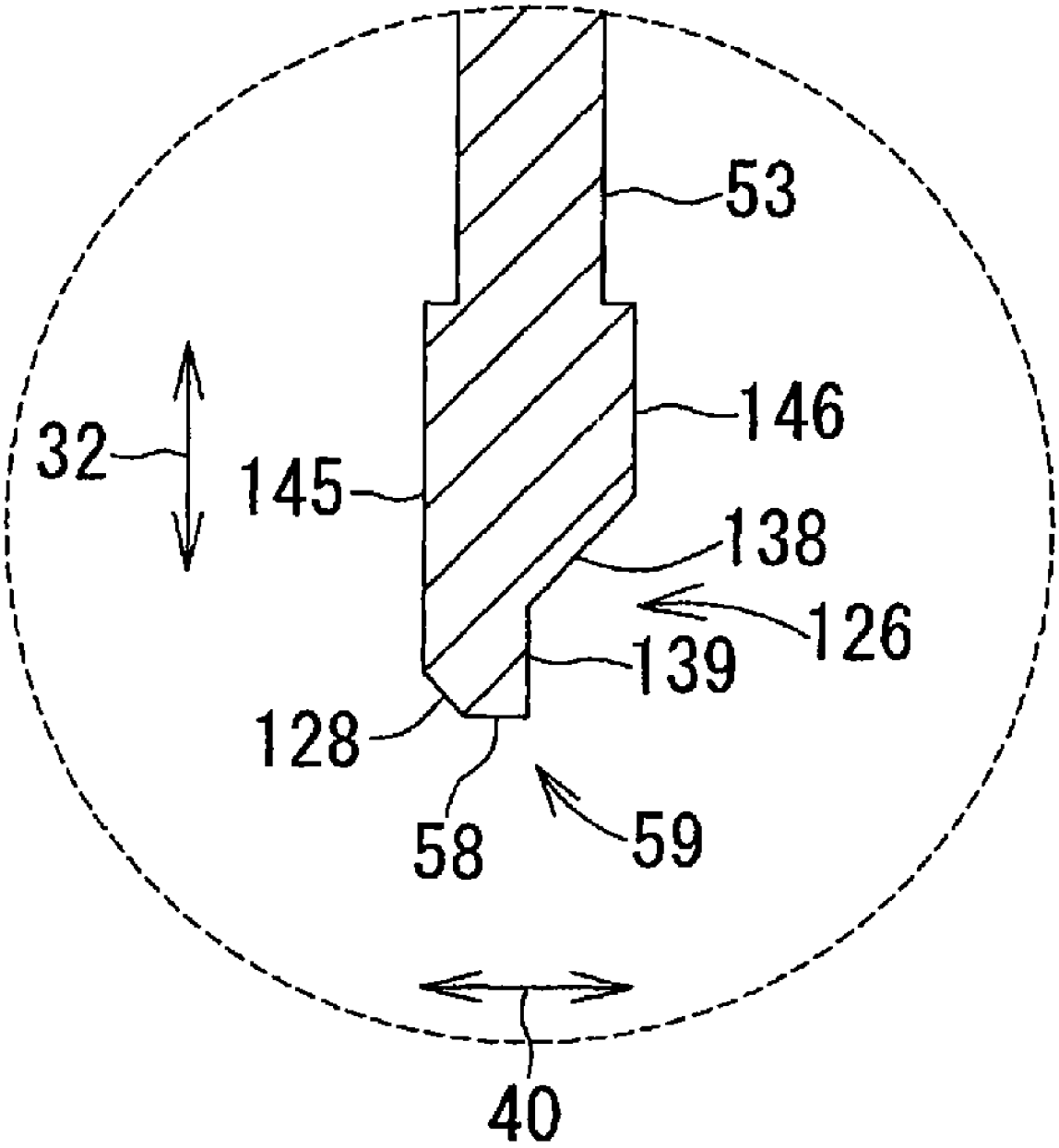
FIG. 15 is a cross-sectional view of the leading end of the reinforcing plate taken along the line XV-XV in FIG. 11.

Referring to FIGS. 4-6, the ribs 107-112 may be positioned within a range surrounded by the wall 51. Referring to FIGS. 10 and 12, the frame 50 may comprise a reinforcing plate 53 which partitions an upper space of the ink chamber 100 at the center in the widthwise direction 31 integrally with the wall 51. The ribs 107-112 may be integral with the wall 51 or the reinforcing plate 53. Consequently, the wall 51 may be reinforced by the reinforcing plate 53 or the ribs 107-112. The films 65 also may be adhered to the ribs 107-112 at the both end portions in the widthwise direction 31. Referring to FIG. 7, the lower portion of the ink chamber 100, e.g., a space 102, below the partitioning panel 53 may not be partitioned in the widthwise direction 31.

A bearing plate 74 may be positioned at the center of the wall 51 in the widthwise direction and may protrude therefrom. The bearing plate 74 may be positioned on the wall 51 at a position adjacent to a corner defined by the front surface 41 and the lower surface 44. The bearing plate 74 may be positioned at the end portion on the right side surface 46 side of the wall 51, and may protrude therefrom. The bearing plate 74 may have a bearing 67, e.g., a circular bearing, positioned on the surface of the side of the left side surface 45. A shaft 77, e.g., a shaft having a column shape, may be fitted to the bearing 67, and a shaft opening 78 of the arm 70 may be fitted on the shaft 77. Accordingly, the arm 70 may be arranged substantially at the center of the frame in the widthwise direction 31. The other end of the shaft 77 may be supported by the supporting block 170.

An ink injection portion 105 may be positioned at the rear surface 42 of the frame 50. The ink injection portion 105 may have a circular hole formed therethrough, which may allow fluid communication between the rear surface 42 and the ink chamber 100. The ink injection portion 105 may be integral with the frame 50 adjacent to the leading end of the rear surface 42. The ink injection portion 105 communicates with the ink chamber 100. Ink is injected into the ink chamber 100 through the ink injection portion 105.

The front surface 41 of the frame 50 may have translucent portion 140 extending therefrom. The translucent portion 140 may be used to detect the amount of ink stored in the ink chamber 100. The translucent portion 140 may be integral with the frame 50, and may comprise the same material as the frame 50. The translucent portion 140 may be irradiated with light by an optical sensor, such as photo interrupter, attached to the recording apparatus. The optical sensor has a light-emitting element and a light-receiving element: In this embodiment, the side wall 140B may be irradiated with light emitted from the light-emitting element and detected light which passes through the side wall 140B may be received by the light-receiving element.

The translucent portion 140 may protrude outward from a portion of the front surface 41 adjacent to the middle portion thereof. The translucent portion 140 may be defined by five wall surfaces forming a substantially rectangular shape, and the space 142 may correspond to an interior thereof, and may have a hollow rectangular box shape. For example, the translucent portion 140 may be defined by a front wall 140A extending in parallel to the front surface 41, a pair of side walls 140B, an upper wall 140C, and a lower wall 140D. The width of the front wall 140A may be less than the width of the front surface 41.

The air communication valve 80 may be positioned above the translucent portion 140. The air communication valve 80 may be configured to selectively open and close a through hole 81 to allow fluid communication with the atmosphere. The air communication valve 80 may comprise a valve body 87, a spring 86, a sealing member 83, and a cap 85. The air communication valve 80 may open the through hole 81 hermetically when the ink cartridge 10 is mounted to the recording apparatus, and when the ink cartridge 10 is not mounted to the recording apparatus, the air communication valve 80 may close the through hole 81. Alternatively, the air communication valve 80 may be replaced by a vinyl adhesive tape or film.

The ink supply valve 90 may be positioned below the translucent portion 140. The ink supply valve 90 may be configured to selectively open and close a through hole 91 to allow ink to be dispensed from an interior of ink chamber 100 to an exterior of ink chamber 100. The ink supply valve 90 may comprise a valve body 97, a spring 96, a spring receiver 94, a sealing member 93, and a cap 95. The ink supply valve 90 may close the through hole 91 when the ink cartridge 10 is not mounted to the recording apparatus, and may open the through hole 91 when the ink cartridge is mounted to the recording apparatus and an ink needle (not shown) applies a force to ink supply valve 90, such that ink flows from the ink chamber 100 to the recording apparatus via the needle.

The arm 70 may be used to determine whether the amount of ink in the ink chamber 100 is greater than a predetermined or a sufficient amount of ink. The arm 70 may comprise a signal blocking portion 72 which may be positioned at a first end of the arm 70. The signal blocking portion 72 may be configured to be positioned within the inner space 142 or outside the inner space 142 based on the amount of ink in the ink chamber 100. The arm 70 also may comprise a float portion 73 positioned at a second end of the arm 70. The arm 70 may have a shaft hole 78 formed therethrough at substantially a center thereof. The shaft 77 may be inserted into the shaft hole 78. The shaft 77 may be configured to rotatably support the arm 70, and may be supported by the bearing 67 positioned on the bearing plate 74 at a first end thereof, and by the supporting block 170 at second end thereof. The arm 70 may be rotatably supported by the shaft 77 to be pivotable in the first direction and the second direction, which is perpendicular to the widthwise direction. The shaft 77 may be separate from or integral with the arm 70.

The interior of the float portion 73 may be hollow, and may float on ink. Alternatively, the float portion 73 may have a specific gravity which is less than the specific gravity of ink. Therefore, the float portion 73 may be displaced upward when a level of the ink in the chamber 100 is reduced to be lower than a predetermined ink level, and the arm 70 rotates in accordance with the movement of the float portion 73. In this embodiment, the float portion 73 may be configured to allow a second portion 76 from the shaft hole 78 to the float portion float in the ink.

The signal blocking portion 72 may be configured to indicate whether the amount of ink in the ink chamber 100 is less than a sufficient amount of ink. When the arm 70 is rotated clockwise in FIG. 5, the signal blocking portion 72 moves into the space 142 of the translucent portion 140. The signal blocking portion 72 may contact the inner surface of the bottom wall 140D of the translucent portion 140 to prevent the further rotation thereof, and to position the arm 70 in the first position. When the arm 70 is rotated counterclockwise in FIG. 5, the signal blocking portion 72 moves away from the inner surface of the bottom wall 140D to position the arm 70 in a second position.

In this embodiment, a second portion 76 of the arm 70 may have a weight which is greater than a weight of a first position 75 of the arm 70 extending from the shaft hollow 78 toward the signal blocking portion 72, such that in air, the second portion 76 is heavier than the first portion 75. Consequently, when the amount of ink within in the ink chamber 100 is relatively low, the arm 70 rotates counterclockwise in FIG. 5 about the shaft 77, and the signal blocking portion 72 moves out of the space 142 of the translucent portion 140 to indicate that the amount of ink in the ink chamber 100 is less than a sufficient amount of ink.

When the float portion 73 is positioned in the ink, a buoyancy is generated at the float portion 73, such that the arm 70 rotates clockwise in FIG. 5 about the shaft 77, and the signal blocking portion 72 moves into the space 142, which indicates that the amount of ink in the ink chamber 100 is greater than the predetermined amount of ink. Alternatively, the arm 70 may be replaced by a floating member (not shown) to provide an indication as to whether the amount of ink in the ink chamber is greater than a sufficient amount of ink.

The first portion 75 may comprise a first sub-portion 63 and a second sub-portion 62. Each of the first and second sub-portions 63 and 62 has a first end and a second end. The first end of the first sub-portion 63 may be connected to the signal blocking portion 72, the second end of the first sub-portion 63 may be connected to a first end of the second sub-portion 62, and the second end of the second sub-portion 63 may be connected to the shaft hole. The first sub portion 62 and the second sub portion 63 may form an acute angle corner therebetween, and the corner of the first sub portion 62 and the second sub portion 63 may comprise the bent portion 71.

The first portion 75 may be a thin plate. For example, the first portion 75 may have a shape extending in a predetermined direction indicated by an arrow 35. The first portion 75 may comprise a first rib 64 positioned along the longitudinal direction of the first portion 75. The first rib 64 may be positioned on both the left side surface and the right side surface of the first portion 75. The first portion 75 is reinforced by the rib 64.

For example, the projections 61, 68, and 69 may extend from the first plane surface 66 of the first portion 75 in a direction parallel to a direction in which the first portion 75 pivots between a first position and a second position in a second direction. The projections 65 may break or pop a film of ink formed between the first portion 75 and the surface of ink, or may prevent the film of ink from being formed between the first portion 75 and the surface of ink. Each of the plurality of projections 61, 68, and 69 may have a base connected to the first plane surface 66 and a peak. Moreover, a thickness of the base may be greater than a thickness of the peak. The projections 61, 68, and 69 are disposed at a predetermined interval from a portion adjacent to the shaft hole 78 to a portion adjacent to the signal blocking portion 72. The projection provided on the first plane surface 66 on the upper side of the first portion 75 projects toward the leading end 59 of the reinforcing plate 53. The projections 68 provided on the first plane surface 66 on the lower side of the first portion 75 projects toward upper ends 159 of supporting portions 189 of the supporting block 170 (see FIG. 9). The projection 61 provided on the first plane surface 66 of the first portion 75 on the float portion 73 side projects toward the rear surface 42.

The protecting member 150 may be attached around the arm 70. The protecting member 150 may be fabricated by bending a linear steel member, such as a wire or a line. The protecting member 150 may comprise a U-shaped portion 150A bent into a U-shape (see FIG. 7). The protecting member 150 may be fixed to the frame 50 by engaging the U-shaped portion 150A with a hook 131 formed on the protecting member 150 and inserting an end portion 150B of the frame 50 into a hole (not shown) formed in the bearing plate 74 and a hole 183 formed on the supporting block 170, respectively.

The supporting block 170 may be configured to support the shaft 77 (see FIG. 7) and the films 65, such that the support block 170 may prevent the films 165 from deforming inwardly, which may maximize a storage capacity of the ink chamber 100. The supporting block 170 may be positioned at the lower portion of the ink chamber 100 in the space 102, and may be configured to be removably mounted to the frame 50. Alternatively, the supporting block 170 may be formed integrally with the frame 50.

The supporting block 170 may comprise a plate and a plurality of ribs 174-177. The plate 171 and the ribs 174-177 may be integral and may comprise the same material as the frame 50. The rib 174 and the rib 175 may be positioned on a first surface 172 of the plate 171 and may protrude in the vertical direction. The ribs 174 and 175 may have an L-shape. In this embodiment, the rib 174 and the rib 175 may be separated and may define an opening 179 therebetween, e.g., a substantially C-shaped opening. In this embodiment, the first portion 75 of the arm 70 may be inserted into the opening 179, such that the arm 70 is pivotable or movable within the range of the opening 179.

The supporting block 170 may have a supporting portion 189 extending from the rib 175 substantially in the horizontal direction. The supporting portion 189 may extend from a substantially center portion of the rib 175 in the direction opposite to the rib 174. The supporting portion 189 may comprise the rib 176 and the rib 177. The rib 176 and the rib 177 may be separated from each other to be positioned dispersedly in the space 102.

The reinforcing plate 53 may be a plate-shaped member for reinforcing the frame 50. The reinforcing plate 53 may have a substantially trapezoidal shape comprising an upper side which contacts the rib 111 and a lower side which contacts the wall 51 on the front surface 41. The reinforcing plate 53 may attach to an inner wall surface 55 of the wall 51 on the front surface 41, the inner wall surface 55 on the upper surface 43, and the inner wall surface 55 on the rear surface 42. The inner wall surface 55 may positioned immediately above the ink injection portion 105.

The leading end 59 of the reinforcing plate 53 may be configured to extend from the inner wall surface 55 toward the rib 111 via the rib 110. The leading end 59 may extend obliquely upward from the back surface 42 toward the front surface 41. In this embodiment, the leading end 59 may be slanted and may extend substantially parallel to the direction of extension 37 of the arm 70, e.g., the leading end 59 of the reinforcing plate 53 may extend in the direction in which the first portion 75 pivots.

The reinforcing plate 53 may comprise the ribs 107-112 extending upright from the left side surface 145 and the right side surface 146. Therefore, the reinforcing plate 53 may be positioned at the center of the frame 50 in the widthwise direction 31. The arm 70 may be positioned substantially at the center of the frame 50 in the widthwise direction 31 by the bearing plate 74 arranged on the right side surface 46 of the arm 70 and the supporting block 170 arranged on the left side surface 45 of the arm 70 when the shaft 77 is inserted into the shaft hole 78. In other words, the leading end 59 of the reinforcing plate 53 may be positioned on a level flush with a surface of rotation of the arm 70. The plane of rotation of the arm 70 is a plane defined by a trajectory of the first portion 75 when the arm 70 is rotated.

The leading end 59 of the reinforcing plate 53 may have a first plurality of recesses 121, 123, 125, and 127, and a second plurality of recesses 122, 124, and 126. The first recesses 121, 123, 125, and 127 are positioned on the left side surface 145 of the reinforcing plate 53, and the second recesses 122, 124, and 126 are positioned on the right side surface 146 of the reinforcing plate 53. The first recess 121, the second recess 122, and the first recess 123 are positioned on the leading end 59 between the rib 111 and the rib 109 in sequence from the front surface 41 to the back surface 42. The second recess 124, the first recess 125, the second recess 126, and the first recess 127 are positioned on the leading end 59 between the rib 109 and the rib 110 in sequence. Consequently, the first recesses 121, 123, 125, and 127 and the second recess 122, 124, and 126 are arranged in the longitudinal direction 39 alternately on the left side surface 145 and the right side surface 146.

The first recess 127 may be positioned on the left side surface 145 of the leading end 59 of the reinforcing plate 53. The first recess 127 extends in a direction of thickness 40 of the reinforcing plate 53 from the left side surface 145. The first recess 127 may be shaped, such that a portion of the left side surface 145 of the leading end 59 is cut off toward the right side surface 146. The leading end 59 of the reinforcing plate 53 may be formed with a vertical portion 135 and a slanted portion 136. The vertical portion 135 may be positioned substantially at the center of the reinforcing plate 53 in the direction of thickness 40, and may extend in a direction of height 32. The slanted portion 136 may be inclined obliquely upward from the upper end of the vertical portion 135 toward the left side surface 145. The depth of the first recess 127 of the reinforcing plate 53 in the direction of thickness 40 is set, such that the vertical portion 135 is positioned on the side of the right side surface 146 of a vertical portion 139 of the recess 126 which is adjacent to the first recess 127 (see FIG. 13). The first recesses 121, 123, and 125 may have the same shape as the first recess 127.

The second recess 126 may be positioned on the right side surface 146 on the leading end 59 of the reinforcing plate 53. The second recess 126 extends in the direction of thickness 40 of the reinforcing plate 53 from the right side surface 146. The second recess 126 may be shaped, such that a portion of the right side surface 146 of the leading end 59 of the reinforcing plate 53 is removed toward the left side surface 145. The vertical portion 139 may be positioned substantially at the center of the reinforcing plate 53 in the direction of thickness 40, and may extend in the direction of height 32. The slanted portion 138 may be slanted obliquely upward from the upper end of the vertical portion 139 toward the right side surface 146. The depth of the second recess 126 of the reinforcing plate 53 in the direction of thickness 40 may be selected, such that the vertical portion 139 is positioned on the left side surface 145 with respect to the vertical portion 135 of the first recess 127 which is adjacent to the second recess 126. The second recess 122 and 124 may have substantially the same shape as the second recess 126.

The leading end 59 of the reinforcing plate 53 is provided with the first recesses 125 and 127 and the second recesses 124 and 126, such that the leading end 59 is formed with second edges 212 and 214 and third edges 206-209. These edges are a portion of the peripheral edge of the leading end 59 which comprises the leading end surface 58 of the reinforcing plate 53. The second edges 212 and 214 are peripheral edges of the leading end 59 which have a second component. The second component may be a component extending in the direction of thickness of the reinforcing plate 53 among direction components 40 of the peripheral edge of the leading end 59. In other words, the edges which comprise the leading end surface 58 and have a component extending in the direction of thickness 40 correspond to the second edges 212 and 214. In this embodiment, the vertical portions 135 of the first recesses 125 and 127 are arranged on the right side surface 146 with respect to the vertical portions 139 of the second recesses 124 and 126. In other words, the vertical portions 139 of the second recesses 124 and 126 are arranged on the left side surface 145 with respect to the vertical portions 135 of the first recesses 125 and 127. Therefore, the second edges 212 extend to the right side surface 146 with respect to the vertical portion 139. The second edges 214 extend to the left side surface 145 with respect to the vertical portions 135. The third edges 207 and 209 are edges which comprise the leading end of the vertical portion 135. The third edges 206 and 208 are edges which comprise the leading end of the vertical portion 139. The third edges 207 and 209 may intersect with the second edges 212 provided on the left side surface 145 of the reinforcing plate 53. The third edges 206 and 208 may intersect with the second edges 214 provided on the right side surface 146 of the reinforcing plate 53.

The leading end 59 of the reinforcing plate 53 may have slanted surfaces 128 extending in the longitudinal direction 39 at both sides in the direction of thickness 40. The slanted surfaces 128 are formed by chamfering the edges of the leading end 59 extending in the longitudinal direction 39. The slanted surfaces 128 are provided and slant obliquely upward with respect to the leading end surface 58 of the reinforcing plate 53. The slanted surfaces 128 on the left side surface 145 extend obliquely upward from the leading end surface 58 toward the left side surface 145. Because the inclined surfaces 128 are formed at the leading end 59, the leading end 59 is formed with first edges 211 on the inner side of the reinforcing plate 53 with respect to the left side surface 145 in the direction of thickness 40. The slanted surfaces 128 on the right side surface 146 extend obliquely upward from the leading end surface 58 toward the right side surface 146. Because the inclined surfaces 128 are formed on the leading end 59, the leading end 59 is formed with first edges 213 on the inner side of the reinforcing plate 53 with respect to the right side surface 146 in the direction of thickness 40.

The first edges 211 and 213 may comprise a portion of the peripheral edge of the leading end 59 which comprises the leading end surface 58 of the reinforcing plate 53. The first edges 211 and 213 are edges of the leading end 59 having the first component. The first component may be a component extending in the longitudinal direction 39 among direction components of the peripheral edge of the leading end 59. The leading end 59 is formed with two first edges 211. The first edges 211 on the left side surface 145 are formed between the rib 109 and one of the second edges 212 formed by the first recess 125 and between the other second edges 212 formed by the first recess 125 and the second edges 212 formed by the first recess 127. The first edges 213 on the right side surface 146 are formed between the second edges 214 formed by the second recess 124 and one of the second edges 214 formed by the second recess 126 and between the other second edges 214 formed by the second recess 126 and the rib 110.

The leading end 59 of the reinforcing plate 53 is formed with corner portions 226 by intersections of the first edges 211 and the second edges 212. The leading end 59 of the reinforcing plate 53 is formed with corner portions 225 by intersections of the first edges 213 and the second edges 214. The corner portions 226 each are formed by the first edge 211 and the second edges 212 intersecting substantially orthogonally to each other, and the corner portions 225 each are formed by the first edge 213 and the second edges 214 intersecting substantially orthogonally to each other. The first edges 211 and the second edges 212 are continued via the corner portions 226. Therefore, the peripheral edges (first edges 211) on the left side surface 145 of the leading end surface 58 extending in the longitudinal direction 39 are bent in the direction of thickness 40 via the corner portions 226. The first edges 213 and the second edges 214 are continued via the corner portions 225. Therefore, the peripheral edges (first edges 213) on the right side surface 146 of the leading end surface 58 extending in the longitudinal direction 39 are bent in the direction of thickness 40 via the corner portions 225. In this embodiment, the corner portions 225 and 226 are provided on the leading end 59. Nevertheless, the intersecting portions between the first edges 213 and the second edges 214 and the intersecting portions between the first edges 213 and the second edges 214 may be chamfered.

As described above, the first edges 211 and 213 are provided on the leading end 59 by the inclined surfaces provided on the leading end 59. The second edges 212 and 214 are provided on the leading end 59 by the first recesses 125 and 127 and the second recesses 124 and 126 provided on the leading end 59. Accordingly, the leading end surface 58 having the peripheral edge including the pair of first edges 211 and 213, the second edges 212 and 214, and the third edges 206-209 are formed on the leading end 59 of the reinforcing plate 53. As described above, because the third edges 207 and 209 are provided on the right side surface 146 with respect to the third edges 206 and 208 in the direction of thickness 40, the leading end surface 58 includes an S-shape repetitively continuing in the longitudinal direction 39 (see FIG. 13).

The corner portions 226 are provided at positions where the first edges 211 intersect with the second edges 212, and the corners 225 are provided at positions where the first edges 213 intersect with the second edges 214. Accordingly, the edges (211 and 213) on the leading end surface 58 extending linearly in the direction of thickness 40 are segmented.

The leading end 59 and the leading end surface 56 of the reinforcing plate 53 positioned between the rib 111 and the rib 109 may be configured in the same manner as the leading end 59 and the leading end surface 58 of the reinforcing plate 53 positioned between the rib 109 and the rib 110. Accordingly, the first edge 201 extending linearly in the longitudinal direction 39 is segmented by the second edges 202 extending in the direction of thickness 40. Moreover, the first edge 203 extending linearly in the longitudinal direction 39 is segmented by the second edges 204 extending in the direction of thickness 40.

In this embodiment, the four recesses (first recess 121, second recess 122, first recess 123, and a recess not shown) are provided between the rib 111 and the rib 109, and the four recesses (second recess 124, first recess 125, second recess 126, and first recess 127) are provided between the rib 109 and the rib 110. Nevertheless, the number of recesses in the invention is not limited thereto, and the number of recesses arranged on the leading end 59 of the reinforcing plate 53 may be changed as needed according to the distance between the rib 111 and the rib 109, the distance between the rib 109 and the rib 110, the dimensions of the recesses, and the like.

Figure 16:
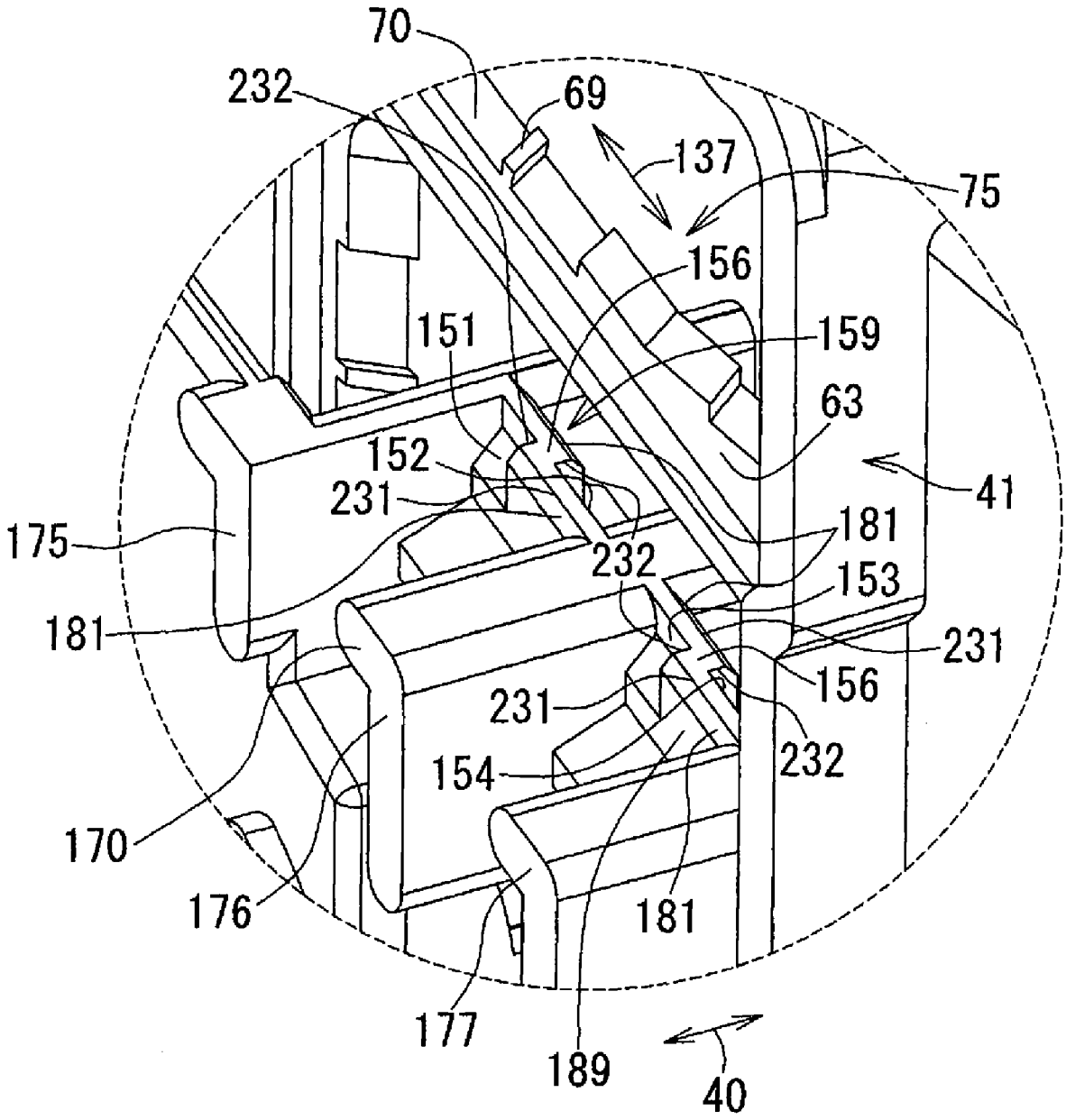
FIG. 16 is an enlarged view of a portion XVI in FIG. 4.
Figure 17:
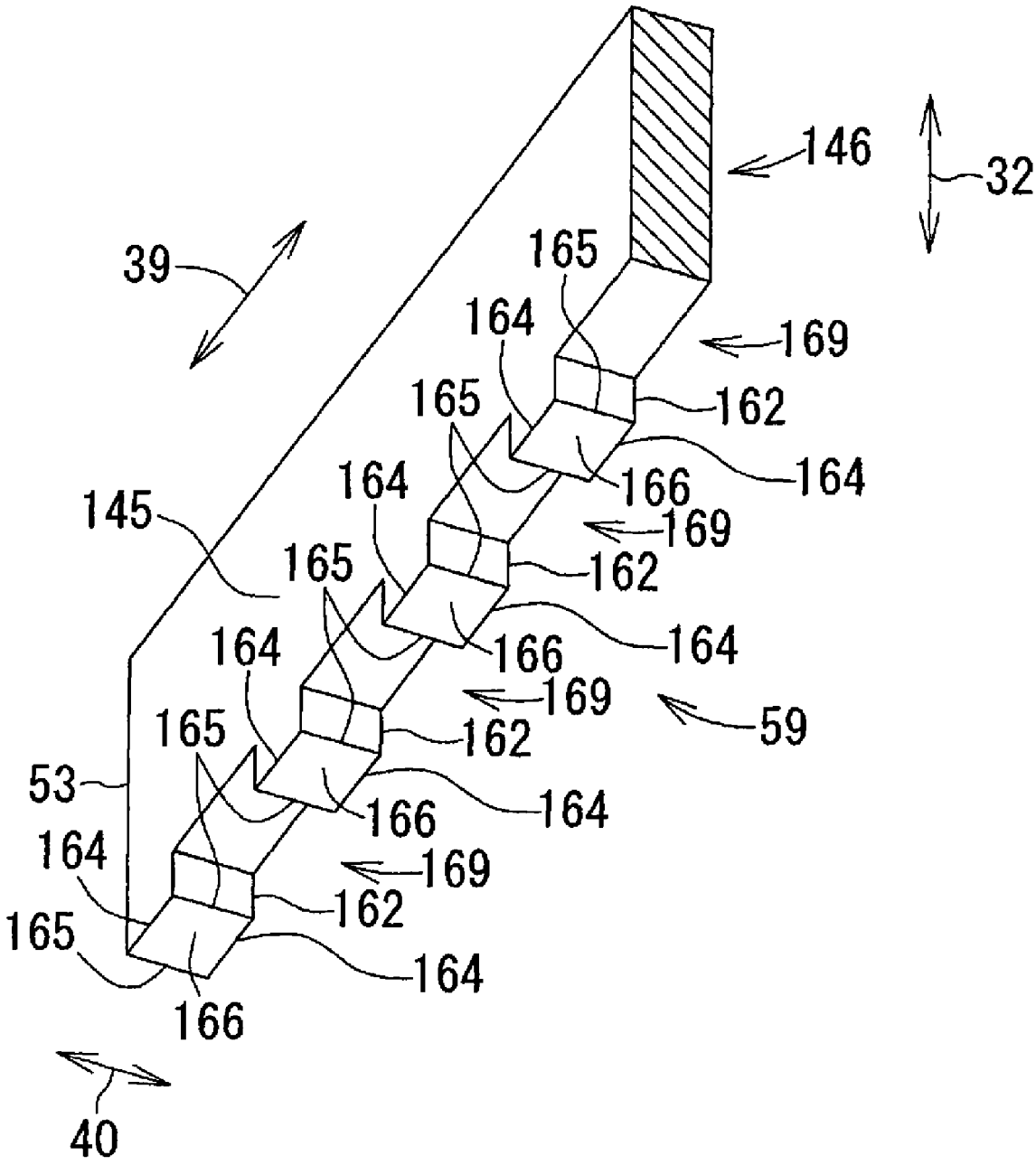
FIG. 17 is a pattern diagram showing the leading end of the reinforcing plate provided with penetrating portions.

Referring to FIG. 16, the upper ends 159 of the supporting portions 189 of the supporting block 170 will be described. As shown in FIG. 16, the upper ends 159 of the supporting portions 189 are arranged substantially just under the first portion 75 of the arm 70 by the supporting block 170 attached to the frame 50. Specifically, the upper ends 159 of the supporting portions 189 are arranged on a level flush with the surface of rotation of the arm 70. In this case, the upper ends 159 of the supporting portions 189 extend substantially in parallel with the direction of extension of the second subportion 63 (see FIG. 16) of the arm 70. Accordingly, the upper ends 159 of the supporting portions 189 are arranged substantially just under the projections 68 (see FIG. 8) provided on the first plane surface 66 on the lower side of the first portion 75.

Four recesses 151-154 are provided on the upper ends 159 of the supporting portions 189. More specifically, the recesses 151 and 152 are provided on the upper ends 159 of the supporting portions 189 between the rib 175 and the rib 176. The recesses 153 and 154 are provided on the upper ends 159 of the supporting portions 189 between the rib 176 and the rib 177. The recesses 151 and 153 are provided on the upper ends 159 of the supporting portions 189 on the left side surface 45 side. The recesses 152 and 154 are provided on the upper ends 159 of the supporting portions 189 on the right side surface 46 side. The recesses 151 and 153 may have substantially the same shape as the first recess 127 (see FIG. 14) inverted upside down. The recesses 152 and 154 may have substantially the same shape as the second recess 126 (see FIG. 15) inverted upside down. The upper ends 159 are provided with inclined surfaces 181 which are the same as the inclined surfaces 128. Accordingly, upper end surfaces 156 are formed on the upper ends 159 of the supporting portions 189. The upper end surfaces 156 are formed on the upper ends 159 so as to include first edges 231 (and second edges 232 as part of the peripheral edge. The first edges 231 are edges extending in the longitudinal direction 137 of the supporting portions 189. The second edges 232 are edges extending in the direction of thickness 40 of the supporting portions 189. The peripheral edges (first edges 231) of the upper end surfaces 156 extending in the longitudinal direction 137 are bent from the longitudinal direction 137 in the direction of thickness 40 by the first edges 231 and the second edges 232 intersecting with each other. Accordingly, the peripheral edges (first edges 231) of the upper end surfaces 156 extending linearly in the longitudinal direction 137 are segmented at positions intersecting with the second edges 232.

As described above, the edge of the leading end 59 of the reinforcing plate 53 extending in the longitudinal direction 39 is bent from the longitudinal direction 39 in the direction of thickness 40 (see FIG. 12). More specifically, the first edge 211 intersects with the second edges 212, the first edge 213 intersects with the second edges 214, the first edge 201 intersects with the second edges 202, and the first edge 203 intersects with the second edges 204. Therefore, the tendency of an ink film to be formed between the leading end 59 of the reinforcing plate 53 and the first portion 75 of the arm 70 is reduced. Consequently, operation of the arm 70 is prevented from being hindered by the ink film, and the arm 70 may pivot smoothly.

The edges of the upper ends 159 of the supporting portions 189 extending in the longitudinal direction 137 are bent in the direction of thickness 40 (see FIG. 16). More specifically, the first edges 231 intersect with the second edges 232. Therefore, the tendency of an ink film to be formed between the upper ends 159 of the supporting portions 189 and the first portion 75 of the arm 70 is reduced.

The leading end 59 of the reinforcing plate 53 is provided with corner portions 255 and 256. Therefore, the tendency of an ink film to be formed is lower than the case in which the portion where the first edges 211 intersects with the second edges 212 and the portion where the first edges 213 intersects with the second edges 214 are chamfered.

As described above, the leading end surface 58 may have an S-shape. Consequently, the edge of the leading end 59 of the reinforcing plate 53 is not extended linearly in the direction of thickness 40. Therefore, the tendency of an ink film to be formed along the leading end 59 is reduced.

In this embodiment, the projections 69 projecting toward the leading end 59 of the reinforcing plate 53 and the projections 68 projecting toward the upper ends 159 of the supporting portions 189 are provided on the first portion 75 of the arm 70. Accordingly, the upper side and the lower side of the first portion 75 are formed with convexo-concave. Accordingly, the tendency of ink films to be formed between the first portion 75 of the arm 70 and the leading end 59 of the reinforcing plate 53 and between the first portion 75 and the upper ends 159 of the supporting portions 189 is reduced.

Through portions 169 may be provided on the leading end 59 of the reinforcing plate 53 instead of the first recesses 121, 123, 125, and 127 and the second recesses 122, 124, and 126. The through portions 169 are provided so as to penetrate through the leading end 59 between the left side surface 145 and the right side surface 146 in the direction of thickness 40 of the reinforcing plate 53. The through portions 169 are arranged in the longitudinal direction 39 of the reinforcing plate 53 at predetermined intervals. Accordingly, the leading end 59 of the reinforcing plate 53 is formed into a shape having areas provided with the through portions removed therefrom. Accordingly, the leading end 59 of the reinforcing plate 53 includes the through portions 169 and projections 162 arranged alternately in the longitudinal direction 39.

The leading end 59 of the reinforcing plate 53 is formed with second edges 165 by the provision of the through portions 169. The second edges 165 comprise a portion of the peripheral edge at the leading end of the projections 162, and extend in the direction of thickness 40 between the left side surface 145 and the right side surface 146.

The leading end of the projection 162 is formed with first edges 164. A pair of the first edges 164 are provided on both sides of the leading end 59 so as to extend in the longitudinal direction 39. The pair of first edges 164 and the second edges 165 intersecting with the first edges 164 define a leading end surface 166 at the leading ends of the projections 162. The leading end surface 166 is segmented by the through portions 169 with respect to the direction of thickness 40. In other words, the first edges 164 extending in the longitudinal direction 39 at the leading end surface 166 are segmented by the through portions 169. Accordingly, the tendency of an ink film to be formed along the leading end 59 of the reinforcing plate 53 is reduced.

Figure 18:
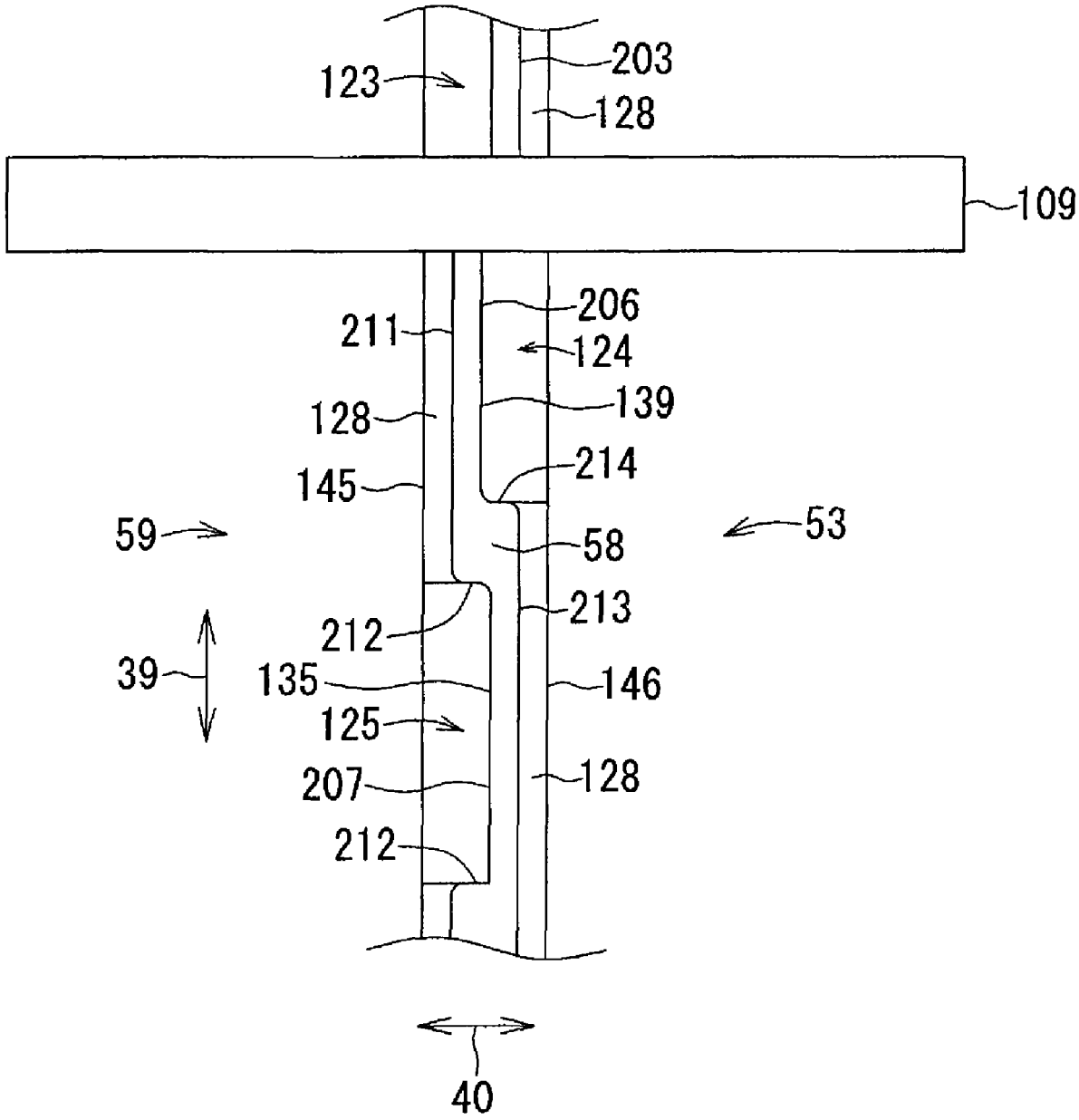
FIG. 18 is a pattern diagram showing the leading end of the reinforcing plate in which an intersection between a first edge and second edges and an intersection between a first edge and second edges are chamfered.

The corner portions 225 and 226 do not necessarily have to be provided on the leading end 59 of the reinforcing plate 53. In other words, as shown in FIG. 18, the intersection between the first edge 211 and the second edges 212 and the intersection between the first edge 213 and the second edges 214 may be chambered.

Figure 19:
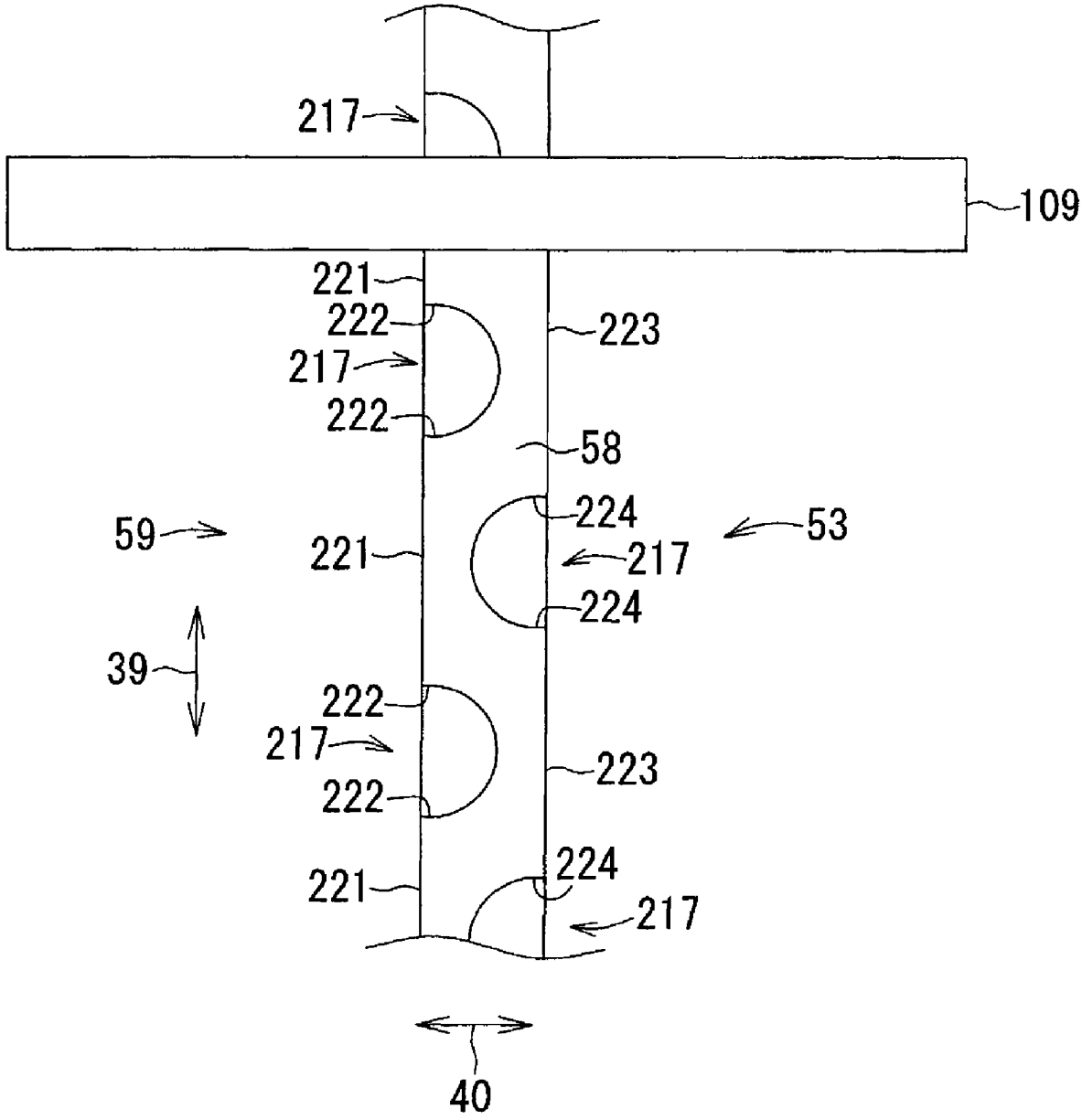
FIG. 19 is a pattern diagram showing the leading end of the reinforcing plate in which a curved portion is formed thereon.

In this embodiment, the mode in which the leading end surface 58 is formed into an S-shape has been described. However, the leading end surface 58 may be formed into a shape other than the S-shape (see FIG. 19, for example). The leading end 59 of the reinforcing plate 53 shown in FIG. 19 is provided with curved portions 217 on both sides in the direction of thickness 40. The curved portion 217 is formed so as to remove the leading end surface 58 in an arcuate shape. With the provision of the curved portions 217 on the leading end surface 58, the first edges 221 and 223 extending in the longitudinal direction 39 are segmented by the second edges 222 and 224.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An ink cartridge comprising:

a frame, wherein at least the frame defines an ink chamber therein, and the ink chamber is configured to store ink therein;

a translucent portion extending from the frame in a first direction, wherein the translucent portion has an inner space formed therein, and the inner space is configured to be in fluid communication with the ink chamber;

a movable member configured to selectively move within the ink chamber in a second direction between a first position and a second position and in a third direction opposite the second direction between the second position and the first position based on an amount of ink in the ink chamber, wherein the first direction is substantially perpendicular to the second direction and the third direction, and the movable member comprises:

a signal blocking portion configured to be positioned within the inner space of the translucent portion; and an arm portion connected to the signal blocking portion, wherein the arm portion is positioned within the ink chamber and outside the translucent portion, and the arm portion comprises a first portion and a second portion, wherein the first portion is raised with respect to the second portion in one of the second direction and the third direction; and a partitioning member extending from the frame towards the movable member, wherein the partitioning member comprises a plurality of particular projections configured to prevent ink film from forming between the partitioning member and the movable member, and each of the plurality of particular projections extend from a surface of the partitioning member in the second direction.

2. The ink cartridge of claim 1, wherein the first portion has a first edge and the second portion has a second edge connected to the first edge, and the first edge and the second edge are non-rounded edges.

3. The ink cartridge of claim 2, wherein the first portion has a first surface and the second portion has a second surface, and the first surface and the second surface each have a substantially constant slope.

4. The ink cartridge of claim 3, wherein the slope is greater than or less than zero.

5. The ink cartridge of claim 1, wherein the arm further comprises a third portion, and the third portion is raised with respect to the second portion in one of the second direction and the third direction, wherein the first portion and the third portion are aligned in the first direction.

6. The ink cartridge of claim 1, wherein the partitioning member extends from the frame towards the movable member, the partitioning member comprises a third portion and a fourth portion, and the third portion is raised with respect to the fourth portion, wherein a plane which is at least parallel to the first direction and the second direction intersects each of the first portion, the second portion, the third portion, and the fourth portion.

7. An ink cartridge comprising;

a frame, wherein at least the frame defines an ink chamber therein, and the ink chamber is configured to store ink therein;

a movable member configured to move within the ink chamber in a first direction and a second direction opposite the first direction, wherein the movable member comprises a plurality of projections, wherein each of the plurality of projections extend from a surface of the movable member in one of the first direction and the second direction; and a partitioning member extending from the frame towards the movable member, wherein the partitioning member comprises a plurality of particular projections configured to prevent ink film from forming between the partitioning member and the movable member, and each of the plurality of particular projections extend from a surface of the partitioning member in the second direction.

8. The ink cartridge of claim 7, further comprising a translucent portion extending from the frame, wherein the translucent portion has an inner space formed therein, and the movable member comprises a signal blocking portion and an arm portion connected to the signal blocking portion, wherein the signal blocking portion is configured to be positioned within the inner space, and the arm portion is positioned outside the inner space, wherein the plurality of projections extend from the arm portion.

9. The ink cartridge of claim 7, wherein each of the plurality of projections has an edge which is connected to the surface, wherein the edge is a non-rounded edge, and the surface is a non-curved surface.

10. The ink cartridge of claim 9, wherein each of the plurality of projections has an edge which is connected to the surface, wherein the edge is a non-rounded edge, and the surface is a non-curved surface.

11. The ink cartridge of claim 10, wherein each of the plurality of projections has a particular surface, and the surface and the particular surface each have a substantially constant slope.

12. The ink cartridge of claim 11, wherein the slope is greater than or less than zero.

13. The ink cartridge of claim 12, wherein the movable member is configured to move in a first direction and a second direction opposite the first direction, and the plurality of projections comprises a first projection and a second projection, wherein the first projection and the second projection are aligned in a direction which is substantially perpendicular to the first direction and the second direction.

14. The ink cartridge of claim 7, wherein the partitioning member extends from the frame towards the movable member, wherein the plurality of projections comprise a first projection and a second projection, and the plurality of particular projections comprise a third projection and a fourth projection, wherein a plane which is at least parallel to the first direction and the second direction intersects each of the first projection, the second projection, the third projection, and the fourth projection.

15. An ink cartridge comprising;

a frame, wherein at least the frame defines an ink chamber therein, and the ink chamber is configured to store ink therein; and a movable member configured to move within the ink chamber in a first direction and a second direction opposite the first direction, wherein the movable member has at least one groove formed therein, wherein the at least one groove is bound by a first portion, a second portion opposite the first portion, and a base connected to the first portion and the second portion, wherein the base faces toward an opening of the at least one groove, and the base is exposed in one of the first direction and the second direction; and a partitioning member extending from the frame towards the movable member, wherein the partitioning member comprises a plurality of particular projections configured to prevent ink film from forming between the partitioning member and the movable member, and each of the plurality of particular projections extend from a surface of the partitioning member in the second direction.

16. The ink cartridge of claim 15, further comprising a partitioning member extending from the frame towards the movable member, wherein the partitioning member comprises at least one particular groove formed therein, and the at least one groove comprises a first groove and a second groove, wherein the at least one particular groove comprises a third groove and a fourth groove, and a plane which is at least parallel to the first direction and the second direction intersects each of the first groove, the second groove, the third groove, and the fourth groove.

17. The ink cartridge of claim 15, wherein the at least one groove comprises a plurality of grooves.

18. The ink cartridge of claim 15, wherein the first portion has a first edge, the second portion has a second edge, and the base has a third edge connected to the first edge and a fourth edge connected to the second edge, wherein the first edge, the second, edge, the third edge, and the fourth edge are non-rounded edges.

19. The ink cartridge of claim 18, wherein the first portion has a first surface, the second portion has a second surface, and the base has a third surface, wherein the first surface, the second surface, and the third surface each have a substantially constant slope.

20. The ink cartridge of claim 19, wherein the slope is greater than or less than zero.

21. The ink cartridge of claim 20, wherein the at least one groove comprises a first groove and a second groove, and the first groove and the second groove are aligned in a direction which is substantially perpendicular to the first direction and the second direction.

22. The ink cartridge of claim 15, further comprising a translucent portion extending from the frame, wherein the translucent portion has an inner space formed therein, and the movable member comprises a signal blocking portion and an arm portion connected to the signal blocking portion, wherein the signal blocking portion is configured to be positioned within the inner space, and the arm portion is positioned outside the inner space, wherein the at least one groove is formed in the arm portion.

23. The ink cartridge of claim 22, wherein the partitioning member divides a portion of the ink chamber into a first chamber portion and a second chamber portion.

24. An ink cartridge comprising;

a frame, wherein at least the frame defines an ink chamber therein, wherein the ink chamber is configured to store ink therein;

a movable member configured to move within the ink chamber; and a partitioning member extending from the frame towards the movable member, wherein the partitioning member comprises a plurality of projections configured to prevent ink film from forming between the partitioning member and the movable member and extending from a surface of the partitioning member toward the movable member in a particular direction.

25. The ink cartridge of claim 24, wherein each of the plurality of projections has an edge which is connected to the surface, wherein the edge is a non-rounded edge, and the surface is a non-curved surface.

26. The ink cartridge of claim 25, wherein each of the plurality of projections has a particular surface, and the surface and the particular surface each have a substantially constant slope.

27. The ink cartridge of claim 26, wherein the slope is greater than or less than zero.

28. The ink cartridge of claim 24, wherein the movable member is configured to move in a first direction and a second direction opposite the first direction, and the plurality of projections comprises a first projection and a second projection, wherein the first projection and the second projection are aligned in a direction which is substantially perpendicular to the first direction and the second direction.

29. An ink cartridge comprising;

a frame, wherein at least the frame defines an ink chamber therein, and the ink chamber is configured to store ink therein; and a movable member configured to move within the ink chamber; and a partitioning member extending from the frame towards the movable member, wherein the partitioning member comprises a plurality of particular projections configured to prevent ink film from forming between the partitioning member and the movable member, and each of the plurality of particular projections extend from a surface of the partitioning member, and the partitioning member has at least one groove formed therein, and the at least one groove is bound by a first portion, a second portion opposite the first portion, and a base connected to the first portion and the second portion, wherein the base faces toward an opening of the at least one groove, and the base is exposed in a direction toward the movable member.

30. The ink cartridge of claim 29, wherein the at least one groove comprises a plurality of grooves.

31. The ink cartridge of claim 29, wherein the partitioning member divides a portion of the ink chamber into a first chamber portion and a second chamber portion.

32. The ink cartridge of claim 29, wherein the first portion has a first edge, the second portion has a second edge, and the base has a third edge connected to the first edge and a fourth edge connected to the second edge, wherein the first edge, the second, edge, the third edge, and the fourth edge are non-rounded edges.

33. The ink cartridge of claim 32, wherein the first portion has a first surface, the second portion has a second surface, and the base has a third surface, wherein the first surface, the second surface, and the third surface each have a substantially constant slope.

34. The ink cartridge of claim 33, wherein the slope is greater than or less than zero.

35. The ink cartridge of claim 34, wherein the movable member is configured to move in a first direction and a second direction opposite the first direction, and the at least one groove comprises a first groove and a second groove, wherein the first groove and the second groove are aligned in a direction which is substantially perpendicular to the first direction and the second direction.

* * * * *